US010945921B2

(12) United States Patent
Denenburg

(10) Patent No.: US 10,945,921 B2
(45) Date of Patent: Mar. 16, 2021

(54) USER ACTUATED LIQUID DRUG TRANSFER DEVICES FOR USE IN READY-TO-USE (RTU) LIQUID DRUG TRANSFER ASSEMBLAGES

(71) Applicant: West Pharma. Services IL, Ltd., Ra'anana (IL)

(72) Inventor: Igor Denenburg, Gedera (IL)

(73) Assignee: WEST PHARMA. SERVICES IL, LTD., Ra'anana (IL)

( * ) Notice: Subject to any disclaimer, the term of this patent is extended or adjusted under 35 U.S.C. 154(b) by 0 days.

(21) Appl. No.: 16/494,974

(22) PCT Filed: Mar. 23, 2018

(86) PCT No.: PCT/IL2018/050336
§ 371 (c)(1),
(2) Date: Sep. 17, 2019

(87) PCT Pub. No.: WO2018/178971
PCT Pub. Date: Oct. 4, 2018

(65) Prior Publication Data

US 2020/0276084 A1 Sep. 3, 2020

(30) Foreign Application Priority Data

Mar. 29, 2017 (IL) ..... 251458

(51) Int. Cl.
*A61J 1/20* (2006.01)

(52) U.S. Cl.
CPC ..... *A61J 1/2089* (2013.01); *A61J 1/2013* (2015.05); *A61J 1/2048* (2015.05); *A61J 1/2058* (2015.05)

(58) Field of Classification Search
CPC ..... A61J 1/20–2096
See application file for complete search history.

(56) References Cited

U.S. PATENT DOCUMENTS 62,333 A 2/1867 Holl
247,975 A 10/1881 Wickes
(Continued)

FOREIGN PATENT DOCUMENTS

CA 2946559 A1 10/2015
CN 1636605 A 7/2005
(Continued)

OTHER PUBLICATIONS

Summit International Medical Technologies Inc., Vial Direct to Bag Spike 2020.

(Continued)

*Primary Examiner* — Benjamin J Klein
(74) *Attorney, Agent, or Firm* — Panitch Schwarze Belisario & Nadel LLP

(57) ABSTRACT

Liquid drug transfer device for use in a Ready-To-Use liquid drug transfer assemblage for establishing flow communication between a liquid source and an injection vial. The liquid drug transfer device includes an injection vial adapter for mounting on an intact injection vial having an injection vial stopper without puncturing same, a liquid source adapter for attachment to a liquid source, a dual ended liquid transfer member for flow communication with the liquid source and puncturing an injection vial stopper, a safety catch mechanism requiring an initial manual linear sliding extension for priming the liquid drug transfer device, an extension limit arrangement for limiting the linear sliding extension, and a snap fit securing arrangement for securing the liquid source adapter on the injection vial adapter after actuation.

7 Claims, 13 Drawing Sheets

(56) References Cited

U.S. PATENT DOCUMENTS

| | | | |
|---|---|---|---|
| 254,444 | A | 2/1882 | Vogel |
| 300,060 | A | 6/1884 | Ford |
| 1,021,681 | A | 3/1912 | Jennings |
| 1,704,817 | A | 3/1929 | Ayers |
| 1,930,944 | A | 10/1933 | Schmitz, Jr. |
| 2,326,490 | A | 8/1943 | Perelson |
| 2,560,162 | A | 7/1951 | Garwood |
| 2,748,769 | A | 6/1956 | Huber |
| 2,830,587 | A | 4/1958 | Everett |
| 2,931,668 | A | 4/1960 | Baley |
| 2,968,497 | A | 1/1961 | Treleman |
| 3,059,643 | A | 10/1962 | Barton |
| D198,499 | S | 6/1964 | Harautuneian |
| 3,225,763 | A | 12/1965 | Waterman |
| 3,277,893 | A | 10/1966 | Clark |
| 3,308,822 | A | 3/1967 | De Luca |
| 3,484,849 | A | 12/1969 | Huebner et al. |
| 3,618,637 | A | 11/1971 | Santomieri |
| 3,757,981 | A | 9/1973 | Harris, Sr. et al. |
| 3,782,365 | A | 1/1974 | Pinna |
| 3,788,524 | A | 1/1974 | Davis et al. |
| 3,822,700 | A | 7/1974 | Pennington |
| 3,826,261 | A | 7/1974 | Killinger |
| 3,872,992 | A | 3/1975 | Larson |
| 3,885,607 | A | 5/1975 | Peltier |
| 3,938,520 | A | 2/1976 | Scislowicz et al. |
| 3,957,052 | A | 5/1976 | Topham |
| 3,977,555 | A | 8/1976 | Larson |
| 3,993,063 | A | 11/1976 | Larrabee |
| 4,020,839 | A | 5/1977 | Klapp |
| 4,026,128 | A | 5/1977 | Blanco |
| 4,051,852 | A | 10/1977 | Villari |
| D247,975 | S | 5/1978 | Luther |
| D248,568 | S | 7/1978 | Ismach |
| 4,109,670 | A | 8/1978 | Slagel |
| 4,121,585 | A | 10/1978 | Becker, Jr. |
| 4,161,178 | A | 7/1979 | Genese |
| 4,187,848 | A | 2/1980 | Taylor |
| D254,444 | S | 3/1980 | Levine |
| 4,203,067 | A | 5/1980 | Fitzky et al. |
| 4,203,443 | A | 5/1980 | Genese |
| 4,210,173 | A | 7/1980 | Choksi et al. |
| D257,286 | S | 10/1980 | Folkman |
| 4,253,501 | A | 3/1981 | Ogle |
| 4,296,786 | A | 10/1981 | Brignola |
| 4,303,067 | A | 12/1981 | Connolly et al. |
| 4,312,349 | A | 1/1982 | Cohen |
| 4,314,586 | A | 2/1982 | Folkman |
| 4,328,802 | A | 5/1982 | Curley et al. |
| 4,335,717 | A | 6/1982 | Bujan et al. |
| D267,199 | S | 12/1982 | Koenig |
| 4,376,634 | A | 3/1983 | Prior et al. |
| D268,871 | S | 5/1983 | Benham et al. |
| 4,392,850 | A | 7/1983 | Elias et al. |
| D270,282 | S | 8/1983 | Gross |
| 4,410,321 | A | 10/1983 | Pearson et al. |
| 4,411,662 | A | 10/1983 | Pearson |
| D271,421 | S | 11/1983 | Fetterman |
| 4,434,823 | A | 3/1984 | Hudspith |
| 4,465,471 | A | 8/1984 | Harris et al. |
| 4,475,915 | A | 10/1984 | Sloane |
| 4,493,348 | A | 1/1985 | Lemmons |
| 4,505,709 | A | 3/1985 | Froning et al. |
| 4,507,113 | A | 3/1985 | Dunlap |
| D280,018 | S | 8/1985 | Scott |
| 4,532,969 | A | 8/1985 | Kwaan |
| 4,564,054 | A | 1/1986 | Gustavsson |
| 4,573,993 | A | 3/1986 | Hoag et al. |
| 4,576,211 | A | 3/1986 | Valentini et al. |
| 4,581,014 | A | 4/1986 | Millerd et al. |
| 4,585,446 | A | 4/1986 | Kempf |
| 4,588,396 | A | 5/1986 | Stroebel et al. |
| 4,588,403 | A | 5/1986 | Weiss et al. |
| D284,603 | S | 7/1986 | Loignon |
| 4,604,093 | A | 8/1986 | Brown et al. |
| 4,607,671 | A | 8/1986 | Aalto et al. |
| 4,614,437 | A | 9/1986 | Buehler |
| 4,638,975 | A | 1/1987 | Iuchi et al. |
| 4,639,019 | A | 1/1987 | Mittleman |
| 4,667,927 | A | 5/1987 | Oscarsson |
| 4,675,020 | A | 6/1987 | McPhee |
| 4,676,530 | A | 6/1987 | Nordgren et al. |
| 4,683,975 | A | 8/1987 | Booth et al. |
| 4,697,622 | A | 10/1987 | Swift et al. |
| 4,721,133 | A | 1/1988 | Sundblom |
| 4,729,401 | A | 3/1988 | Raines |
| 4,735,608 | A | 4/1988 | Sardam |
| 4,743,229 | A | 5/1988 | Chu |
| 4,743,243 | A | 5/1988 | Vaillancourt |
| 4,752,292 | A | 6/1988 | Lopez et al. |
| 4,758,235 | A | 7/1988 | Tu |
| 4,759,756 | A | 7/1988 | Forman et al. |
| 4,778,447 | A | 10/1988 | Velde et al. |
| 4,787,898 | A | 11/1988 | Raines |
| 4,797,898 | A | 1/1989 | Martinez |
| D300,060 | S | 2/1989 | Molgaard-Nielsen |
| 4,804,366 | A | 2/1989 | Zdeb et al. |
| 4,826,492 | A | 5/1989 | Magasi |
| 4,832,690 | A | 5/1989 | Kuu |
| 4,834,152 | A | 5/1989 | Howson et al. |
| D303,013 | S | 8/1989 | Konopka |
| 4,857,062 | A | 8/1989 | Russell |
| 4,865,592 | A | 9/1989 | Rycroft |
| 4,871,463 | A | 10/1989 | Taylor et al. |
| 4,898,209 | A | 2/1990 | Zbed |
| 4,909,290 | A | 3/1990 | Coccia |
| 4,919,596 | A | 4/1990 | Slate et al. |
| 4,927,423 | A | 5/1990 | Malmborg |
| 4,931,040 | A | 6/1990 | Haber et al. |
| 4,932,944 | A | 6/1990 | Jagger et al. |
| 4,967,797 | A | 11/1990 | Manska |
| D314,050 | S | 1/1991 | Sone |
| D314,622 | S | 2/1991 | Andersson et al. |
| 4,997,430 | A | 3/1991 | Van der Heiden et al. |
| 5,006,114 | A | 4/1991 | Rogers et al. |
| 5,035,686 | A | 7/1991 | Crittenden et al. |
| 5,041,105 | A | 8/1991 | D'Alo et al. |
| 5,045,066 | A | 9/1991 | Scheuble et al. |
| 5,049,129 | A | 9/1991 | Zdeb et al. |
| 5,053,015 | A | 10/1991 | Gross |
| 5,061,248 | A | 10/1991 | Sacco |
| 5,088,996 | A | 2/1992 | Kopfer et al. |
| 5,096,575 | A | 3/1992 | Cosack |
| 5,104,387 | A | 4/1992 | Pokorney et al. |
| 5,113,904 | A | 5/1992 | Aslanian |
| 5,122,124 | A | 6/1992 | Novacek et al. |
| 5,125,908 | A | 6/1992 | Cohen |
| 5,125,915 | A | 6/1992 | Berry et al. |
| D328,788 | S | 8/1992 | Sagae et al. |
| 5,171,230 | A | 12/1992 | Eland et al. |
| 5,201,705 | A | 4/1993 | Berglund et al. |
| 5,201,717 | A | 4/1993 | Wyatt et al. |
| 5,203,771 | A | 4/1993 | Melker et al. |
| 5,203,775 | A | 4/1993 | Frank et al. |
| 5,211,638 | A | 5/1993 | Dudar et al. |
| 5,232,029 | A | 8/1993 | Knox et al. |
| 5,232,109 | A | 8/1993 | Tirrell et al. |
| 5,242,432 | A | 9/1993 | DeFrank |
| 5,247,972 | A | 9/1993 | Tetreault |
| D341,420 | S | 11/1993 | Conn |
| 5,269,768 | A | 12/1993 | Cheung |
| 5,270,219 | A | 12/1993 | DeCastro et al. |
| 5,279,576 | A | 1/1994 | Loo et al. |
| 5,288,290 | A | 2/1994 | Brody |
| 5,300,034 | A | 4/1994 | Behnke et al. |
| 5,301,685 | A | 4/1994 | Guirguis |
| 5,304,163 | A | 4/1994 | Bonnici et al. |
| 5,304,165 | A | 4/1994 | Haber et al. |
| 5,308,483 | A | 5/1994 | Sklar et al. |
| 5,312,377 | A | 5/1994 | Dalton |
| 5,328,474 | A | 7/1994 | Raines |
| D349,648 | S | 8/1994 | Tirrell et al. |
| 5,334,163 | A | 8/1994 | Sinnett |
| 5,334,179 | A | 8/1994 | Poli et al. |

(56) References Cited

U.S. PATENT DOCUMENTS 5,342,346 A 8/1994 Honda et al.
5,344,417 A 9/1994 Wadsworth, Jr.
5,348,544 A 9/1994 Sweeney et al.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,482,446 A 1/1996 Williamson et al.
5,492,147 A 2/1996 Challender et al.
5,496,274 A 3/1996 Graves et al.
D369,406 S 4/1996 Niedospial et al.
5,505,714 A 4/1996 Dassa et al.
5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,562,686 A 10/1996 Sauer et al.
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,658,133 A 8/1997 Anderson et al.
5,672,160 A 9/1997 Osterlind et al.
5,674,195 A 10/1997 Truthan
5,676,346 A 10/1997 Leinsing
5,685,845 A 11/1997 Grimard
D388,172 S 12/1997 Cipes
5,699,821 A 12/1997 Paradis
5,702,019 A 12/1997 Grimard
5,718,346 A 2/1998 Weiler
5,728,087 A 3/1998 Niedospial, Jr.
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
5,814,020 A 9/1998 Gross
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,868,710 A 2/1999 Battiato et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,941,850 A 8/1999 Shah et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.
6,080,132 A 6/2000 Cole et al.
D428,141 S 7/2000 Brotspies et al.
6,086,762 A 7/2000 Guala
6,089,541 A 7/2000 Weinheimer et al.
6,090,091 A 7/2000 Fowles et al.
6,090,093 A 7/2000 Thibault et al.
6,092,692 A 7/2000 Riskin
D430,291 S 8/2000 Jansen et al.
6,099,511 A 8/2000 Devos et al.
6,113,068 A 9/2000 Ryan
6,113,571 A 9/2000 Zinger et al.
6,113,583 A 9/2000 Fowles et al.
6,117,114 A 9/2000 Paradis
D431,864 S 10/2000 Jansen
6,139,534 A 10/2000 Niedospial, Jr. et al.
6,142,446 A 11/2000 Leinsing
6,146,362 A 11/2000 Turnbull et al.
6,149,623 A 11/2000 Reynolds

(56) References Cited

U.S. PATENT DOCUMENTS 6,156,025 A 12/2000 Niedospial, Jr. et al.
6,159,192 A 12/2000 Fowles et al.
6,168,037 B1 1/2001 Grimard
6,171,287 B1 1/2001 Lynn et al.
6,171,293 B1 1/2001 Rowley et al.
6,173,852 B1 1/2001 Browne
6,173,868 B1 1/2001 DeJonge
6,174,304 B1 1/2001 Weston
6,179,822 B1 1/2001 Niedospial, Jr.
6,179,823 B1 1/2001 Niedospial, Jr.
6,186,997 B1 2/2001 Gabbard et al.
6,206,861 B1 3/2001 Mayer
6,221,041 B1 4/2001 Russo
6,221,054 B1 4/2001 Martin et al.
6,221,065 B1 4/2001 Davis
6,238,372 B1 5/2001 Zinger et al.
6,245,044 B1 6/2001 Daw et al.
D445,501 S 7/2001 Niedospial, Jr.
D445,895 S 7/2001 Svendsen
6,253,804 B1 7/2001 Safabash
6,258,078 B1 7/2001 Thilly
6,280,430 B1 8/2001 Neftel et al.
6,290,688 B1 9/2001 Lopez et al.
6,296,621 B1 10/2001 Masuda et al.
6,299,131 B1 10/2001 Ryan
6,343,629 B1 2/2002 Wessman et al.
6,348,044 B1 2/2002 Coletti et al.
6,358,236 B1 3/2002 DeFoggi et al.
6,364,866 B1 4/2002 Furr et al.
6,378,576 B2 4/2002 Thibault et al.
6,378,714 B1 4/2002 Jansen et al.
6,379,340 B1 4/2002 Zinger et al.
D457,954 S 5/2002 Wallace et al.
6,382,442 B1 5/2002 Thibault et al.
6,386,397 B2 5/2002 Brotspies et al.
6,408,897 B1 6/2002 Laurent et al.
6,409,708 B1 6/2002 Wessman
6,440,107 B1 8/2002 Trombley, III et al.
6,453,949 B1 9/2002 Chau
6,453,956 B2 9/2002 Safabash
6,474,375 B2 11/2002 Spero et al.
6,478,788 B1 11/2002 Aneas
D468,015 S 12/2002 Horppu
6,499,617 B1 12/2002 Niedospial, Jr. et al.
6,503,240 B1 1/2003 Niedospial, Jr. et al.
6,503,244 B2 1/2003 Hayman
6,520,932 B2 2/2003 Taylor
6,524,278 B1 2/2003 Campbell et al.
6,524,295 B2 2/2003 Daubert et al.
D472,316 S 3/2003 Douglas et al.
6,530,903 B2 3/2003 Wang et al.
6,537,263 B1 3/2003 Aneas
D472,630 S 4/2003 Douglas et al.
6,544,246 B1 4/2003 Niedospial, Jr.
6,551,299 B2 4/2003 Miyoshi et al.
6,558,365 B2 5/2003 Zinger et al.
6,571,837 B2 6/2003 Jansen et al.
6,572,591 B2 6/2003 Mayer
6,575,955 B2 6/2003 Azzolini
6,581,593 B1 6/2003 Rubin et al.
6,582,415 B1 6/2003 Fowles et al.
D476,731 S 7/2003 Cise et al.
6,591,876 B2 7/2003 Safabash
6,599,273 B1 7/2003 Lopez
6,601,721 B2 8/2003 Jansen et al.
6,626,309 B1 9/2003 Jansen et al.
6,632,201 B1 10/2003 Mathias et al.
6,638,244 B1 10/2003 Reynolds
D482,121 S 11/2003 Harding et al.
D482,447 S 11/2003 Harding et al.
6,651,956 B2 11/2003 Miller
6,652,509 B1 11/2003 Helgren et al.
D483,487 S 12/2003 Harding et al.
D483,869 S 12/2003 Tran et al.
6,656,433 B2 12/2003 Sasso
6,666,852 B2 12/2003 Niedospial, Jr.
6,681,810 B2 1/2004 Weston
6,681,946 B1 1/2004 Jansen et al.
6,682,509 B2 1/2004 Lopez
6,692,478 B1 2/2004 Paradis
6,692,829 B2 2/2004 Stubler et al.
6,695,829 B2 2/2004 Hellstrom et al.
6,699,229 B2 3/2004 Zinger et al.
6,706,022 B1 3/2004 Leinsing et al.
6,706,031 B2 3/2004 Manera
6,715,520 B2 4/2004 Andreasson et al.
6,729,370 B2 5/2004 Norton et al.
6,736,798 B2 5/2004 Ohkubo et al.
6,745,998 B2 6/2004 Doyle
6,746,438 B1 6/2004 Amissolle
6,752,180 B2 6/2004 Delay
D495,416 S 8/2004 Dimeo et al.
D496,457 S 9/2004 Prais et al.
6,802,490 B2 10/2004 Leinsing et al.
6,832,994 B2 12/2004 Niedospial, Jr. et al.
6,852,103 B2 2/2005 Fowles et al.
6,875,203 B1 4/2005 Fowles et al.
6,875,205 B2 4/2005 Leinsing
6,878,131 B2 4/2005 Novacek et al.
6,884,253 B1 4/2005 McFarlane
6,890,328 B2 5/2005 Fowles et al.
D506,256 S 6/2005 Miyoshi et al.
6,901,975 B2 6/2005 Aramata et al.
6,945,417 B2 9/2005 Jansen et al.
6,948,522 B2 9/2005 Newbrough et al.
6,949,086 B2 9/2005 Ferguson et al.
6,951,613 B2 10/2005 Reif et al.
6,957,745 B2 10/2005 Thibault et al.
6,960,164 B2 11/2005 O'Heeron
6,972,002 B2 12/2005 Thorne
6,979,318 B1 12/2005 McDonald et al.
RE38,996 E 2/2006 Crawford et al.
6,994,315 B2 2/2006 Ryan et al.
6,997,916 B2 2/2006 Simas, Jr. et al.
6,997,917 B2 2/2006 Niedospial, Jr. et al.
7,024,968 B2 4/2006 Raudabough et al.
7,070,589 B2 7/2006 Lolachi et al.
7,074,216 B2 7/2006 Fowles et al.
7,083,600 B2 8/2006 Meloul
7,086,431 B2 8/2006 D'Antonio et al.
7,097,637 B2 8/2006 Triplett et al.
7,100,890 B2 9/2006 Cote, Sr. et al.
7,140,401 B2 11/2006 Wilcox et al.
7,150,735 B2 12/2006 Hickle
7,192,423 B2 3/2007 Wong
7,195,623 B2 3/2007 Burroughs et al.
7,241,285 B1 7/2007 Dikeman
7,294,122 B2 11/2007 Kubo et al.
7,306,199 B2 12/2007 Leinsing et al.
D561,348 S 2/2008 Zinger et al.
7,326,188 B1 2/2008 Russell et al.
7,326,194 B2 2/2008 Zinger et al.
7,350,764 B2 4/2008 Raybuck
7,354,422 B2 4/2008 Riesenberger et al.
7,354,427 B2 4/2008 Fangrow
7,425,209 B2 9/2008 Fowles et al.
7,435,246 B2 10/2008 Zihlmann
D580,558 S 11/2008 Shigesada et al.
7,452,348 B2 11/2008 Hasegawa
7,470,257 B2 12/2008 Norton et al.
7,470,265 B2 12/2008 Brugger et al.
7,472,932 B2 1/2009 Weber et al.
7,488,297 B2 2/2009 Flaherty
7,491,197 B2 2/2009 Jansen et al.
7,497,848 B2 3/2009 Leinsing et al.
7,523,967 B2 4/2009 Steppe
7,530,546 B2 5/2009 Ryan et al.
D595,420 S 6/2009 Suzuki et al.
D595,421 S 6/2009 Suzuki et al.
7,540,863 B2 6/2009 Haindl
7,540,865 B2 6/2009 Griffin et al.
7,544,191 B2 6/2009 Peluso et al.
D595,862 S 7/2009 Suzuki et al.
D595,863 S 7/2009 Suzuki et al.

(56) References Cited

U.S. PATENT DOCUMENTS

| | | | |
|---|---|---|---|
| 7,611,487 | B2 | 11/2009 | Woehr et al. |
| 7,611,502 | B2 | 11/2009 | Daly |
| 7,615,041 | B2 | 11/2009 | Sullivan et al. |
| 7,628,779 | B2 | 12/2009 | Aneas |
| 7,632,261 | B2 | 12/2009 | Zinger et al. |
| D608,900 | S | 1/2010 | Giraud et al. |
| 7,654,995 | B2 | 2/2010 | Marren et al. |
| 7,670,326 | B2 | 3/2010 | Shemesh |
| 7,695,445 | B2 | 4/2010 | Yuki |
| 7,704,229 | B2 | 4/2010 | Moberg et al. |
| D616,090 | S | 5/2010 | Kawamura |
| 7,713,247 | B2 | 5/2010 | Lopez |
| 7,717,886 | B2 | 5/2010 | Lopez |
| 7,722,090 | B2 | 5/2010 | Burton et al. |
| D616,984 | S | 6/2010 | Gilboa |
| 7,731,678 | B2 | 6/2010 | Tennican et al. |
| 7,743,799 | B2 | 6/2010 | Mosler et al. |
| 7,744,581 | B2 | 6/2010 | Wallen et al. |
| 7,757,901 | B2 | 7/2010 | Welp |
| 7,758,082 | B2 | 7/2010 | Weigel et al. |
| 7,758,560 | B2 | 7/2010 | Connell et al. |
| 7,762,524 | B2 | 7/2010 | Cawthon et al. |
| 7,766,304 | B2 | 8/2010 | Phillips |
| 7,771,383 | B2 | 8/2010 | Truitt et al. |
| D624,641 | S | 9/2010 | Boclet |
| 7,799,009 | B2 | 9/2010 | Niedospial, Jr. et al. |
| 7,803,140 | B2 | 9/2010 | Fangrow, Jr. |
| D627,216 | S | 11/2010 | Fulginiti |
| D630,732 | S | 1/2011 | Lev et al. |
| 7,862,537 | B2 | 1/2011 | Zinger et al. |
| 7,867,215 | B2 | 1/2011 | Akerlund et al. |
| 7,879,018 | B2 | 2/2011 | Zinger et al. |
| 7,883,499 | B2 | 2/2011 | Fangrow |
| 7,895,216 | B2 | 2/2011 | Longshaw et al. |
| D634,007 | S | 3/2011 | Zinger et al. |
| 7,900,659 | B2 | 3/2011 | Whitley et al. |
| D637,713 | S | 5/2011 | Nord et al. |
| 7,963,954 | B2 | 6/2011 | Kavazov |
| D641,080 | S | 7/2011 | Zinger et al. |
| 7,985,216 | B2 | 7/2011 | Daily et al. |
| D644,104 | S | 8/2011 | Maeda et al. |
| 7,993,328 | B2 | 8/2011 | Whitley |
| 8,007,461 | B2 | 8/2011 | Huo et al. |
| 8,012,132 | B2 | 9/2011 | Lum et al. |
| 8,016,809 | B2 | 9/2011 | Zinger et al. |
| 8,021,325 | B2 | 9/2011 | Zinger et al. |
| 8,025,653 | B2 | 9/2011 | Capitaine et al. |
| 8,025,683 | B2 | 9/2011 | Morrison |
| 8,029,472 | B2 | 10/2011 | Leinsing et al. |
| 8,038,123 | B2 | 10/2011 | Ruschke et al. |
| 8,066,688 | B2 | 11/2011 | Zinger et al. |
| 8,070,739 | B2 | 12/2011 | Zinger et al. |
| 8,075,550 | B2 | 12/2011 | Nord et al. |
| 8,096,525 | B2 | 1/2012 | Ryan |
| 8,105,314 | B2 | 1/2012 | Fangrow, Jr. |
| D654,166 | S | 2/2012 | Lair |
| D655,017 | S | 2/2012 | Mosler et al. |
| 8,122,923 | B2 | 2/2012 | Kraus et al. |
| 8,123,736 | B2 | 2/2012 | Kraushaar et al. |
| D655,071 | S | 3/2012 | Davila |
| D657,461 | S | 4/2012 | Schembre et al. |
| 8,152,779 | B2 | 4/2012 | Cabiri |
| 8,157,784 | B2 | 4/2012 | Rogers |
| 8,167,863 | B2 | 5/2012 | Yow |
| 8,172,824 | B2 | 5/2012 | Pfeifer et al. |
| 8,177,768 | B2 | 5/2012 | Leinsing |
| 8,182,452 | B2 | 5/2012 | Mansour et al. |
| 8,187,248 | B2 | 5/2012 | Zihlmann |
| 8,196,614 | B2 | 6/2012 | Kriheli |
| 8,197,459 | B2 | 6/2012 | Jansen et al. |
| 8,211,069 | B2 | 7/2012 | Fangrow, Jr. |
| 8,225,959 | B2 | 7/2012 | Lambrecht |
| 8,241,268 | B2 | 8/2012 | Whitley |
| 8,262,628 | B2 | 9/2012 | Fangrow, Jr. |
| 8,262,641 | B2 | 9/2012 | Vedrine et al. |
| 8,267,127 | B2 | 9/2012 | Kriheli |
| D669,980 | S | 10/2012 | Lev et al. |
| 8,287,513 | B2 | 10/2012 | Ellstrom et al. |
| 8,328,784 | B2 | 12/2012 | Jensen et al. |
| D673,673 | S | 1/2013 | Wang |
| D674,084 | S | 1/2013 | Linnenschmidt |
| D674,088 | S | 1/2013 | Lev et al. |
| 8,348,898 | B2 | 1/2013 | Cabiri |
| D681,230 | S | 4/2013 | Mosler et al. |
| 8,454,573 | B2 | 6/2013 | Wyatt et al. |
| 8,469,939 | B2 | 6/2013 | Fangrow, Jr. |
| 8,475,404 | B2 | 7/2013 | Foshee et al. |
| 8,480,645 | B1 | 7/2013 | Choudhury et al. |
| 8,480,646 | B2 | 7/2013 | Nord et al. |
| 8,506,548 | B2 | 8/2013 | Okiyama |
| 8,511,352 | B2 | 8/2013 | Kraus et al. |
| 8,512,309 | B2 | 8/2013 | Shemesh et al. |
| D690,009 | S | 9/2013 | Schembre et al. |
| D690,418 | S | 9/2013 | Rosenquist |
| 8,523,837 | B2 | 9/2013 | Wiggins et al. |
| 8,545,476 | B2 | 10/2013 | Ariagno et al. |
| 8,551,067 | B2 | 10/2013 | Zinger et al. |
| 8,556,879 | B2 | 10/2013 | Okiyama |
| 8,562,582 | B2 | 10/2013 | Tuckwell et al. |
| 8,608,723 | B2 | 12/2013 | Lev et al. |
| 8,628,508 | B2 | 1/2014 | Weitzel et al. |
| 8,636,689 | B2 | 1/2014 | Halili, Jr. et al. |
| 8,684,992 | B2 | 4/2014 | Sullivan et al. |
| 8,684,994 | B2 | 4/2014 | Lev et al. |
| 8,752,598 | B2 | 6/2014 | Denenburg et al. |
| D714,935 | S | 10/2014 | Nishioka et al. |
| D717,406 | S | 11/2014 | Stanley et al. |
| D717,948 | S | 11/2014 | Strong et al. |
| D719,650 | S | 12/2014 | Arinobe et al. |
| D720,067 | S | 12/2014 | Rosenquist |
| D720,451 | S | 12/2014 | Denenburg et al. |
| D720,452 | S | 12/2014 | Jordan |
| 8,900,212 | B2 | 12/2014 | Kubo |
| 8,905,994 | B1 | 12/2014 | Lev et al. |
| 8,915,882 | B2 | 12/2014 | Cabiri |
| D720,850 | S | 1/2015 | Hsia et al. |
| D732,660 | S | 6/2015 | Ohashi |
| D732,664 | S | 6/2015 | Woehr et al. |
| D733,291 | S | 6/2015 | Wang |
| D733,292 | S | 6/2015 | Rogers |
| D733,293 | S | 6/2015 | Rogers |
| 9,072,827 | B2 | 7/2015 | Cabiri |
| 9,089,475 | B2 | 7/2015 | Fangrow |
| D738,494 | S | 9/2015 | Kashmirian |
| D741,457 | S | 10/2015 | Guest |
| 9,149,575 | B2 | 10/2015 | Cabiri |
| D750,235 | S | 2/2016 | Maurice |
| 9,254,242 | B2 | 2/2016 | Mueller et al. |
| D757,933 | S | 5/2016 | Lev et al. |
| 9,339,438 | B2 | 5/2016 | Lev et al. |
| 9,393,365 | B2 | 7/2016 | Cabiri |
| 9,414,991 | B2 | 8/2016 | Sanders et al. |
| 9,486,391 | B2 | 11/2016 | Shemesh |
| 9,492,610 | B2 | 11/2016 | Cabiri |
| 9,511,190 | B2 | 12/2016 | Cabiri |
| 9,522,234 | B2 | 12/2016 | Cabiri |
| D794,183 | S | 8/2017 | Lev et al. |
| 9,763,855 | B2 | 9/2017 | Fangrow |
| 9,801,786 | B2 | 10/2017 | Lev et al. |
| 10,206,854 | B2 | 2/2019 | Wu et al. |
| 10,376,654 | B2 | 8/2019 | Sanders et al. |
| 2001/0000347 | A1 | 4/2001 | Hellstrom et al. |
| 2001/0025671 | A1 | 10/2001 | Safabash |
| 2001/0029360 | A1 | 10/2001 | Miyoshi et al. |
| 2001/0051793 | A1 | 12/2001 | Weston |
| 2002/0017328 | A1 | 2/2002 | Loo |
| 2002/0055711 | A1 | 5/2002 | Lavi et al. |
| 2002/0065488 | A1 | 5/2002 | Suzuki et al. |
| 2002/0066715 | A1 | 6/2002 | Niedospial |
| 2002/0087118 | A1 | 7/2002 | Reynolds et al. |
| 2002/0087141 | A1 | 7/2002 | Zinger et al. |
| 2002/0087144 | A1 | 7/2002 | Zinger et al. |
| 2002/0104584 | A1 | 8/2002 | Spero et al. |
| 2002/0115980 | A1 | 8/2002 | Niedospial |

(56) References Cited

U.S. PATENT DOCUMENTS

2002/0121496 A1 9/2002 Thiebault et al.
2002/0123736 A1 9/2002 Fowles et al.
2002/0127150 A1 9/2002 Sasso
2002/0128628 A1 9/2002 Fathallah
2002/0138045 A1 9/2002 Moen
2002/0173752 A1 11/2002 Polzin
2002/0193777 A1 12/2002 Aneas
2003/0028156 A1 2/2003 Juliar
2003/0036725 A1 2/2003 Lavi et al.
2003/0068354 A1 4/2003 Reif et al.
2003/0069550 A1 4/2003 Sharp
2003/0073971 A1 4/2003 Saker
2003/0100866 A1 5/2003 Reynolds
2003/0109846 A1 6/2003 Zinger et al.
2003/0120209 A1 6/2003 Jensen et al.
2003/0135159 A1 7/2003 Daily et al.
2003/0153895 A1 8/2003 Leinsing
2003/0187420 A1 10/2003 Akerlund et al.
2003/0191445 A1 10/2003 Wallen et al.
2003/0195479 A1 10/2003 Kuracina et al.
2003/0199827 A1 10/2003 Thorne
2003/0199846 A1* 10/2003 Fowles ..... A61J 1/1406
604/403
2003/0199847 A1 10/2003 Akerlund et al.
2003/0205843 A1 11/2003 Adams
2003/0236543 A1 12/2003 Brenneman et al.
2004/0010207 A1 1/2004 Flaherty et al.
2004/0024354 A1 2/2004 Reynolds
2004/0039365 A1 2/2004 Aramata et al.
2004/0044327 A1 3/2004 Hasegawa
2004/0073189 A1 4/2004 Wyatt et al.
2004/0143218 A1 7/2004 Das
2004/0143226 A1 7/2004 Marsden
2004/0153047 A1 8/2004 Blank et al.
2004/0158172 A1 8/2004 Hancock
2004/0162540 A1 8/2004 Walenciak et al.
2004/0167472 A1 8/2004 Howell et al.
2004/0181192 A1 9/2004 Cuppy
2004/0186424 A1 9/2004 Hjertman
2004/0199139 A1 10/2004 Fowles et al.
2004/0204699 A1 10/2004 Hanly et al.
2004/0217315 A1 11/2004 Doyle
2004/0225274 A1 11/2004 Jansen et al.
2004/0236305 A1 11/2004 Jansen et al.
2004/0249341 A1 12/2004 Newbrough et al.
2004/0255952 A1 12/2004 Carlsen et al.
2005/0015070 A1 1/2005 Delnevo et al.
2005/0016626 A1 1/2005 Wilcox et al.
2005/0049553 A1 3/2005 Triplett et al.
2005/0055008 A1 3/2005 Paradis et al.
2005/0082828 A1 4/2005 Wicks et al.
2005/0124964 A1 6/2005 Niedospial et al.
2005/0137523 A1 6/2005 Wyatt et al.
2005/0137566 A1 6/2005 Fowles et al.
2005/0148994 A1 7/2005 Leinsing
2005/0159706 A1 7/2005 Wilkinson et al.
2005/0159724 A1 7/2005 Enerson
2005/0182383 A1 8/2005 Wallen
2005/0209554 A1 9/2005 Landau
2005/0261637 A1 11/2005 Miller
2005/0277896 A1 12/2005 Messerli et al.
2006/0030832 A1 2/2006 Niedospial et al.
2006/0079834 A1 4/2006 Tennican et al.
2006/0089594 A1 4/2006 Landau
2006/0089603 A1 4/2006 Truitt et al.
2006/0095015 A1 5/2006 Hobbs et al.
2006/0106360 A1 5/2006 Wong
2006/0135948 A1 6/2006 Varma
2006/0155257 A1 7/2006 Reynolds
2006/0161192 A1 7/2006 Young
2006/0173410 A1 8/2006 Moberg et al.
2006/0178646 A1 8/2006 Harris et al.
2006/0195029 A1 8/2006 Shults et al.
2006/0212004 A1 9/2006 Atil
2006/0253084 A1 11/2006 Nordgren
2006/0259004 A1 11/2006 Connell et al.
2007/0016381 A1 1/2007 Kamath et al.
2007/0024995 A1 2/2007 Hayashi
2007/0060904 A1 3/2007 Vedrine et al.
2007/0078428 A1 4/2007 Reynolds et al.
2007/0079894 A1 4/2007 Kraus et al.
2007/0083164 A1 4/2007 Barrelle et al.
2007/0088252 A1 4/2007 Pestotnik et al.
2007/0088293 A1 4/2007 Fangrow
2007/0088313 A1 4/2007 Zinger et al.
2007/0106218 A1 5/2007 Yodfat et al.
2007/0106244 A1 5/2007 Mosler et al.
2007/0112324 A1 5/2007 Hamedi-Sangsari
2007/0156112 A1 7/2007 Walsh
2007/0167904 A1 7/2007 Zinger et al.
2007/0167912 A1 7/2007 Causey et al.
2007/0191760 A1 8/2007 Iguchi et al.
2007/0191764 A1 8/2007 Zihlmann
2007/0191767 A1 8/2007 Hennessy et al.
2007/0203451 A1 8/2007 Murakami et al.
2007/0219483 A1 9/2007 Kitani et al.
2007/0244447 A1 10/2007 Capitaine et al.
2007/0244461 A1 10/2007 Fangrow
2007/0244462 A1 10/2007 Fangrow
2007/0244463 A1 10/2007 Warren et al.
2007/0249995 A1 10/2007 Van Manen
2007/0255202 A1 11/2007 Kitani et al.
2007/0265574 A1 11/2007 Tennican et al.
2007/0265581 A1 11/2007 Funamura et al.
2007/0270778 A9 11/2007 Zinger et al.
2007/0287953 A1 12/2007 Ziv et al.
2007/0299404 A1 12/2007 Katoh et al.
2008/0009789 A1 1/2008 Zinger et al.
2008/0009822 A1 1/2008 Enerson
2008/0015496 A1 1/2008 Hamedi-Sangsari
2008/0132851 A1 6/2008 Shaw et al.
2008/0135051 A1 6/2008 Lee
2008/0172024 A1 7/2008 Yow
2008/0188799 A1 8/2008 Mueller-Beckhaus et al.
2008/0195049 A1 8/2008 Thalmann et al.
2008/0208138 A1 8/2008 Lim et al.
2008/0215015 A1 9/2008 Cindrich et al.
2008/0249473 A1 10/2008 Rutti et al.
2008/0249479 A1 10/2008 Zinger et al.
2008/0249498 A1 10/2008 Fangrow
2008/0262465 A1 10/2008 Zinger et al.
2008/0269687 A1 10/2008 Chong et al.
2008/0275407 A1 11/2008 Scheurer
2008/0287905 A1 11/2008 Hiejima et al.
2008/0294100 A1 11/2008 de Costa et al.
2008/0306439 A1 12/2008 Nelson et al.
2008/0312634 A1 12/2008 Helmerson et al.
2009/0012492 A1 1/2009 Zihlmann
2009/0043253 A1 2/2009 Podaima
2009/0054834 A1 2/2009 Zinger et al.
2009/0054852 A1 2/2009 Takano et al.
2009/0062767 A1 3/2009 Van Antwerp et al.
2009/0076360 A1 3/2009 Brister et al.
2009/0082750 A1 3/2009 Denenburg et al.
2009/0139724 A1 6/2009 Gray et al.
2009/0143758 A1 6/2009 Okiyama
2009/0177177 A1 7/2009 Zinger et al.
2009/0177178 A1 7/2009 Pedersen
2009/0187140 A1 7/2009 Racz
2009/0216103 A1 8/2009 Brister et al.
2009/0216212 A1 8/2009 Fangrow, Jr.
2009/0267011 A1 10/2009 Hatton
2009/0299325 A1 12/2009 Vedrine et al.
2009/0318946 A1 12/2009 Tamesada
2009/0326506 A1 12/2009 Hasegawa et al.
2010/0010443 A1 1/2010 Morgan et al.
2010/0016811 A1 1/2010 Smith
2010/0022985 A1 1/2010 Sullivan et al.
2010/0030181 A1 2/2010 Helle et al.
2010/0036319 A1 2/2010 Drake et al.
2010/0076397 A1 3/2010 Reed et al.
2010/0087786 A1 4/2010 Zinger et al.
2010/0137827 A1 6/2010 Warren et al.
2010/0137831 A1 6/2010 Tsals

(56) References Cited

U.S. PATENT DOCUMENTS

2010/0152658 A1 6/2010 Hanson et al.
2010/0160889 A1 6/2010 Smith et al.
2010/0162548 A1 7/2010 Leidig
2010/0168664 A1 7/2010 Zinger et al.
2010/0168712 A1 7/2010 Tuckwell et al.
2010/0179506 A1 7/2010 Shemesh et al.
2010/0198148 A1 8/2010 Zinger et al.
2010/0204670 A1 8/2010 Kraushaar et al.
2010/0228220 A1 9/2010 Zinger et al.
2010/0241088 A1 9/2010 Ranalletta et al.
2010/0274184 A1 10/2010 Chun
2010/0274202 A1 10/2010 Hyde et al.
2010/0286661 A1 11/2010 Raday et al.
2010/0312220 A1 12/2010 Kalitzki
2011/0004143 A1 1/2011 Beiriger et al.
2011/0004184 A1 1/2011 Proksch et al.
2011/0044850 A1 2/2011 Solomon et al.
2011/0054440 A1 3/2011 Lewis
2011/0087164 A1 4/2011 Mosler et al.
2011/0125056 A1 5/2011 Merchant
2011/0144584 A1 6/2011 Wozencroft
2011/0160655 A1 6/2011 Hanson et al.
2011/0160701 A1 6/2011 Wyatt et al.
2011/0172636 A1 7/2011 Aasmul
2011/0175347 A1 7/2011 Okiyama
2011/0218511 A1 9/2011 Yokoyama
2011/0224640 A1 9/2011 Kuhn et al.
2011/0230856 A1 9/2011 Kyle et al.
2011/0264037 A1 10/2011 Foshee et al.
2011/0264069 A1 10/2011 Bochenko
2011/0276007 A1 11/2011 Denenburg
2011/0319827 A1 12/2011 Leinsing et al.
2012/0022344 A1 1/2012 Kube
2012/0022469 A1 1/2012 Alpert
2012/0053555 A1 3/2012 Ariagno et al.
2012/0059332 A1 3/2012 Woehr et al.
2012/0059346 A1 3/2012 Sheppard et al.
2012/0067429 A1 3/2012 Mosler et al.
2012/0071819 A1 3/2012 Bruggemann et al.
2012/0078214 A1 3/2012 Finke et al.
2012/0123382 A1 5/2012 Kubo
2012/0184938 A1 7/2012 Lev et al.
2012/0215182 A1 8/2012 Mansour et al.
2012/0220977 A1 8/2012 Yow
2012/0220978 A1 8/2012 Lev et al.
2012/0265163 A1 10/2012 Cheng et al.
2012/0271229 A1 10/2012 Lev et al.
2012/0296307 A1 11/2012 Holt et al.
2012/0310203 A1 12/2012 Khaled et al.
2012/0323172 A1 12/2012 Lev et al.
2012/0323187 A1 12/2012 Iwase et al.
2012/0323210 A1 12/2012 Lev et al.
2013/0046269 A1 2/2013 Lev et al.
2013/0053814 A1 2/2013 Mueller-Beckhaus et al.
2013/0096493 A1 4/2013 Kubo et al.
2013/0110049 A1 5/2013 Cronenberg et al.
2013/0144248 A1 6/2013 Putter et al.
2013/0199669 A1 8/2013 Moy et al.
2013/0226100 A1 8/2013 Lev
2013/0231630 A1 9/2013 Kraus et al.
2013/0237904 A1 9/2013 Deneburg et al.
2013/0253448 A1 9/2013 Baron et al.
2013/0289530 A1 10/2013 Wyatt et al.
2014/0020793 A1 1/2014 Denenburg et al.
2014/0096862 A1 4/2014 Aneas
2014/0150911 A1 6/2014 Hanner et al.
2014/0194854 A1 7/2014 Tsals
2014/0221940 A1 8/2014 Clauson et al.
2014/0277052 A1 9/2014 Haselby et al.
2014/0352845 A1 12/2014 Lev et al.
2015/0082746 A1 3/2015 Ivosevic et al.
2015/0088078 A1 3/2015 Lev et al.
2015/0112297 A1 4/2015 Lev et al.
2015/0209232 A1* 7/2015 Haindl ..... A61J 1/1406
604/411
2015/0231034 A1* 8/2015 Lev ..... A61J 1/2051
604/405
2015/0290390 A1 10/2015 Ring et al.
2015/0297839 A1 10/2015 Sanders et al.
2015/0305770 A1 10/2015 Fill et al.
2016/0088995 A1 3/2016 Ueda et al.
2016/0166824 A1 6/2016 Lev et al.
2016/0199569 A1 7/2016 Yevmenenko et al.
2016/0228644 A1 8/2016 Cabiri
2016/0287475 A1 10/2016 Yevmenenko et al.
2016/0367439 A1 12/2016 Davis et al.
2018/0325775 A1* 11/2018 David ..... A61J 1/2096
2019/0133885 A1* 5/2019 Wu ..... A61J 1/2089

FOREIGN PATENT DOCUMENTS

CN 1747683 A 3/2006
CN 1863566 A 11/2006
CN 1950049 A 4/2007
CN 101001661 A 7/2007
CN 101687083 A 3/2010
DE 1064693 B 9/1959
DE 1913926 A1 9/1970
DE 4122476 A1 1/1993
DE 1408498 A1 5/1995
DE 19504413 A1 8/1996
DE 202004012714 U1 11/2004
DE 102007046951 B3 2/2009
DE 202009011019 U1 12/2010
EM 000627237-0001 1/2007
EM 001680703-0002 3/2010
EP 0192661 A1 9/1986
EP 0195018 A1 9/1986
EP 0258913 A2 3/1988
EP 0416454 A2 3/1991
EP 0426403 A 5/1991
EP 0282545 B1 2/1992
EP 0518397 A1 12/1992
EP 0521460 A1 1/1993
EP 582038 A2 2/1994
EP 0598918 A1 6/1994
EP 0637443 A1 2/1995
EP 0737467 A1 10/1996
EP 761562 A1 3/1997
EP 765652 A1 4/1997
EP 765853 A1 4/1997
EP 0806597 A1 11/1997
EP 0814866 A1 1/1998
EP 829248 A2 3/1998
EP 0856331 A2 8/1998
EP 882441 A2 12/1998
EP 0887085 A2 12/1998
EP 0887885 A2 12/1998
EP 897708 A2 2/1999
EP 0898951 A2 3/1999
EP 960616 A2 12/1999
EP 1008337 A1 6/2000
EP 1029526 A1 8/2000
EP 1034809 A1 9/2000
EP 1051988 A2 11/2000
EP 1323403 A1 7/2003
EP 1329210 A1 7/2003
EP 1396250 A1 3/2004
EP 1454609 A1 9/2004
EP 1454650 A1 9/2004
EP 1498097 A2 1/2005
EP 1872824 A1 1/2008
EP 1911432 A1 4/2008
EP 1919432 A1 5/2008
EP 1930038 A2 6/2008
EP 2090278 A1 8/2009
EP 2351548 A1 8/2011
EP 2351549 A1 8/2011
EP 2462913 A1 6/2012
EP 2512399 A1 10/2012
FR 2029242 A5 10/1970
FR 2856660 A1 12/2004
FR 2869795 A1 11/2005
FR 2931363 A1 11/2009

(56) References Cited

FOREIGN PATENT DOCUMENTS

| | | | |
|---|---|---|---|
| GB | 1444210 | A | 7/1976 |
| IL | 171662 | | 10/2005 |
| IL | 186290 | | 1/2008 |
| JP | 03-062426 | B | 9/1991 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | | 5/1998 |
| JP | H10-504736 | A | 5/1998 |
| JP | 11503627 | | 3/1999 |
| JP | 11-319031 | A | 11/1999 |
| JP | 2000-508934 | A | 7/2000 |
| JP | 2000-237278 | A | 9/2000 |
| JP | 2000262497 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-501721 | A | 1/2004 |
| JP | 2004-097253 | A | 4/2004 |
| JP | 2004-522541 | A | 7/2004 |
| JP | 2005-270629 | A | 10/2005 |
| JP | 200661421 | A | 3/2006 |
| JP | 2008-220961 | A | 9/2008 |
| JP | 4329954 | B2 | 9/2009 |
| JP | 2010063622 | A | 3/2010 |
| JP | 2010-179128 | A | 8/2010 |
| JP | 2012-205769 | A | 10/2012 |
| JP | 2014000220 | A | 1/2014 |
| WO | 8601712 | A1 | 3/1986 |
| WO | 8605683 | A1 | 10/1986 |
| WO | 9003536 | A1 | 4/1990 |
| WO | 9403373 | A1 | 2/1994 |
| WO | 9507066 | A1 | 3/1995 |
| WO | 9513785 | A1 | 5/1995 |
| WO | 9600053 | A1 | 1/1996 |
| WO | 9609083 | A1 | 3/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 0132524 | A1 | 5/2001 |
| WO | 0160311 | A1 | 8/2001 |
| WO | 0189607 | A2 | 11/2001 |
| WO | 0191693 | A2 | 12/2001 |
| WO | 0202165 | A2 | 1/2002 |
| WO | 200209797 | A1 | 2/2002 |
| WO | 0232372 | A1 | 4/2002 |
| WO | 0236191 | A2 | 5/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2004096113 | | 11/2004 |
| WO | 2005002492 | A1 | 1/2005 |
| WO | 2005018703 | A2 | 3/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007/105221 | A1 | 9/2007 |
| WO | 2007101772 | A1 | 9/2007 |
| WO | 2008076459 | A1 | 6/2008 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010078227 | A1 | 7/2010 |
| WO | 2010117580 | A1 | 10/2010 |
| WO | 2011/004360 | A1 | 1/2011 |
| WO | 2011039747 | | 4/2011 |
| WO | 2011058545 | A1 | 5/2011 |
| WO | 2011058548 | A1 | 5/2011 |
| WO | 2011077434 | A1 | 6/2011 |
| WO | 2011090955 | A1 | 7/2011 |
| WO | 2011104711 | A1 | 9/2011 |
| WO | 2011156373 | A1 | 12/2011 |
| WO | 2012/004790 | A2 | 1/2012 |
| WO | 2012004784 | A1 | 1/2012 |
| WO | 2012063230 | A1 | 5/2012 |
| WO | 2012143921 | A1 | 10/2012 |
| WO | 2012150587 | A1 | 11/2012 |
| WO | 2013127813 | A1 | 9/2013 |
| WO | 2013134246 | A1 | 9/2013 |
| WO | 2013148435 | A1 | 10/2013 |
| WO | 2013156944 | A1 | 10/2013 |
| WO | 2013156994 | A1 | 10/2013 |
| WO | 2014033706 | A2 | 3/2014 |
| WO | 2014033710 | A1 | 3/2014 |
| WO | 2014099395 | | 6/2014 |
| WO | 2014170888 | A1 | 10/2014 |
| WO | 2014174278 | A1 | 10/2014 |
| WO | 2016023590 | A1 | 2/2016 |
| WO | 2016110838 | A1 | 7/2016 |

OTHER PUBLICATIONS

Merchant "An engineered control device for needle free reconstitution and transfer of compounded sterile intravenous drug solutions for immediate use to assist in complying with United States Pharmacopeia Chapter <797> standard", Adv Care, 2 pages, 2018.

Int'l Search Report and Written opinion dated Jun. 13, 2018 in Int'l Application No. PCT/IL2018/050336.

Grifols Vial Adapter Product Literature, 2 pages, Jan. 2002.

Novel Transfer, Mixing and Drug Delivery Systems, MOP Medimop Medical Projects Ltd. Catalog, 4 pages, Rev. 4, 2004.

Smart Site.RTM. Alaris Medical Systems Product Brochure, 4 pages, Issue 1, Oct. 1999.

MixJect, downloaded from webpage: http://www.westpharma.com/en/products/Pages/Mixject.aspx, Download Date: Aug. 8, 2012, 1 page.

MixJet Product Information Sheet, downloaded from webpage: http://www.westpharma.com/SiteCollectionDocuments/Recon/mixject%20product%20sheet.pdf; 1 page.

Decision to Grant dated Apr. 12, 2010 in EP Application No. 08738307.1.

The MixJect transfer system, as shown in the article, "Advanced Delivery Devices," Drug Delivery Technology Jul./Aug. 2007 vol. 7 No. 7 [on-line]. [Retrieved from Internet May 14, 2010.] URL: <http://www.drugdeiverytech-online.com/drugdelivery/200707/?pg=28pg28>. (3 pages).

Publication date of Israeli Patent Application 186290 [on-line]. ]Retrieved from Internet May 24, 2010]. URL:<http://www.ilpatsearch.justrice.gov.il/UI/RequestsList.aspx>. (1 page).

Silicone Rubber Overview Downloaded from webpage: http://www.knovel.com/web/portal/browse/display?_EXT_KNOVEL_DISPLAY_bookid=1023&VerticalID=0 on Feb. 9, 2011, Download Date: Sep. 2, 2011, Original Posting Date: 2010, 6 pages.

Kipp, "Plastic Material Data Sheets," retrieved from the internet: http://www.knovel.com/web/portal/browse/display?_EXT_KNOVEL_DISPLAY_bookid=1023&VerticalID=0, retrieved on Feb. 9, 2011.

Alaris Medical Systems Product Brochure, 4 pages, Issue 1, Oct. 11, 1999.

(56) References Cited

OTHER PUBLICATIONS

Smart Site Needle-Free Systems, Alaris Medical Systems Webpage, 4 pages, Feb. 2006.
Photographs of Alaris Medical Systems SmartSite.RTM. device, 5 pages, 2002.
Non-Vented Vial Access Pin with ultrasite.rtm. Valve, B. Braun Medical, Inc. website and product description, 3 pages, Feb. 2006.
IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).
Drug Administration Systems product information sheets; http://www.westpharma.com/eu/en/products/Pages/Vial2Bag.aspx; pp. 1-3 (admitted prior art).
Article with picture of West Pharmaceutical Services' Vial2Bag Needleless System, [on-line]; ISIPS Newsletter, Oct. 26, 2007]; retrieved from Internet Feb. 16, 2010]; URL:<http://www.isips.org/reports/ISIPS_Newsletter_October_26_2007. html.> (7 pages. see pp. 5-6).
West, Vial2Bag DC system, Oct. 2, 2014, https://web.archive.org/web/20141002065133/http://www.westpharma.com/en/products/Pages/Reconstitutionsystems.aspx.
Vial2Bag DC, downloaded from webpage: https://www.youtube.com/watch?v=FEOkglxNBrs, Original posting date: Aug. 21, 2014, 1 page.
Vial-Mate Adapter Device, Baxter, May 2017, downloaded from web page:http://www.paxtermedicationdeliveryproducts.com/drug-delivery/vialmate.html, Download Date: Jul. 28, 2017, original posting date: unknown, 1page.

* cited by examiner

USER ACTUATED LIQUID DRUG TRANSFER DEVICES FOR USE IN READY-TO-USE (RTU) LIQUID DRUG TRANSFER ASSEMBLAGES

CROSS-REFERENCE TO RELATED APPLICATIONS

This application is a Section 371 of International Application No. PCT/IL2018/050336, filed Mar. 23, 2018, which was published in the English language on Oct. 4, 2018 under International Publication No. WO 2018/178971 A1, which claims priority under 35 U.S.C. § 119(b) to Israeli Application No. 251458, filed Mar. 29, 2017, the disclosures of which are incorporated herein by reference in their entirety.

FIELD OF THE INVENTION

The invention relates to liquid drug transfer devices suitable for use in Ready-To-Use (RTU) liquid drug transfer assemblages.

BACKGROUND OF THE INVENTION

Ready-To-Use (RTU) liquid drug transfer assemblages include a liquid drug transfer device and at least one intact non-punctured injection vial attached thereto. Such RTU assemblages require a user actuation for puncturing an injection vial for enabling flow communication therewith. Such RTU assemblages can be generally classified into two types as follows: First, a liquid drug transfer device with a user removable injection vial. The liquid drug transfer device can be supplied with a pre-attached injection vial or alternatively a user attaches same in a telescopic snap fit mounting action as a prior step to user actuation for puncturing. And second, a liquid drug transfer device with an irremovable injection vial except by applying extreme force damaging the liquid drug transfer device and/or the injection vial. Such RTU arrangements are particularly beneficial for wide range of usage environments including inter alia home use, out-patient clinic use, and the like.

Commonly owned PCT International Application No. PCT/IL2010/000777 entitled Vial Assemblage with Vial and Pre-Attached Fluid Transfer Device and published under PCT International Publication No. WO 2011/039747 discloses RTU assemblages of the first type. The RTU assemblages include a fluid transfer device having a pre-attached removable injection vial for use with a needleless syringe. The fluid transfer devices include an elongated tubular flow member having a connector for sealing flow communication with a needleless syringe and a puncturing cannula for puncturing an injection. The puncturing cannula tip is embedded in an injection vial stopper. WO 2011/039747 FIG. 9 to FIG. 13 disclose a fluid transfer device with a pull ring type safety catch mechanism. WO 2011/039747 FIG. 14 to FIG. 23 disclose a fluid transfer device with a twist and depress safety catch mechanism.

Commonly owned PCT International Application No. PCT/IL2013/050721 entitled Liquid Drug Transfer Devices employing Manual Rotation for Dual Flow Communication Step Actuations and published under PCT International Publication No. WO 2014/033710 discloses RTU assemblages of both types for enabling flow communication between an injection vial and a liquid source in the form of another injection vial, an infusion liquid container, and the like. The RTU assemblages include liquid drug transfer devices employing different mechanical arrangements for converting manual rotation into a linear displacement for flow communication purposes. Suitable mechanical arrangements include inter alia a screw thread arrangement, a pin and track arrangement, and the like.

Commonly owned PCT International Application No. PCT/IL2014/050327 entitled Drug Container Closure for Mounting on Open-topped Drug Container to form Drug Reconstitution Assemblage for use with Needleless Syringe and published under PCT International Publication No. WO 2014/170888 discloses RTU assemblages of the second type for use with a needleless syringe. The RTU assemblages include a fluid transfer member with an integral needleless syringe connector and a puncturing cannula. The fluid transfer member is manually disposed along a diametric inverted L-shaped track pair from an initial non-puncturing position to a puncturing position. The inverted L-shaped track pair includes one-way snap fit members to prevent a user returning the fluid transfer member to an earlier position and indicating progress of the user activation.

SUMMARY OF THE INVENTION

The present invention is directed towards liquid drug transfer devices for use in Ready-To-Use (RTU) liquid drug transfer assemblages. The liquid drug transfer devices include an injection vial adapter for telescopic mounting on a non-punctured injection vial having an injection vial stopper and an uppermost injection vial surface without puncturing same. An injection vial adapter can be designed to either enable or prevent removal of an injection vial. The liquid drug transfer devices include a liquid source adapter intended for flow communication with a range of liquid sources. Suitable liquid sources include inter alia a needleless syringe with a male connector, an infusion liquid container, and the like.

A liquid source adapter is mounted on an injection vial adapter and configured for telescopically receiving the injection vial adapter therein on a manual linear sliding compaction of a liquid drug transfer device from an initial pre-actuated height H1 to a final actuated height H2 where H2<H1. The liquid drug transfer devices each include a dual ended liquid transfer member with a puncturing tip for puncturing an injection vial stopper. A dual ended liquid transfer member can be either integral formed with a liquid source adapter or a discrete component interdisposed between a liquid source adapter and an injection vial adapter depending on an intended liquid source. The puncturing tip is deployed above an uppermost injection vial surface in a pre-actuated state of a liquid drug transfer device and punctures through the injection vial stopper in the actuated state.

The liquid drug transfer devices include an integral safety catch mechanism for precluding inadvertent user actuation leading to inadvertent puncturing an intact non-punctured injection vial. The safety catch mechanism requires an initial manual linear sliding extension for imparting a short extension of the liquid source adapter from the injection vial adapter for priming the liquid drug transfer device ready for a subsequent manual linear sliding compaction whereupon the liquid source adapter snugly receives the injection vial adapter therein. The compaction stroke is necessarily longer than the extension stroke because the compaction stroke includes causing the puncturing tip to puncture the injection vial stopper. The liquid drug transfer devices include an extension limit arrangement for limiting the extension of the liquid source adapter from the vial injection adapter on priming the safety catch mechanism from its initial pre-actuated state. The liquid drug transfer device includes a snap fit securing arrangement for securing the liquid source adapter on the injection vial adapter in the actuated state.

BRIEF DESCRIPTION OF DRAWINGS

In order to understand the invention and to see how it can be carried out in practice, preferred embodiments will now be described, by way of non-limiting examples only, with reference to the accompanying drawings in which similar parts are likewise numbered, and in which.

DETAILED DESCRIPTION OF PREFERRED EMBODIMENTS OF THE INVENTION

Figure 1:
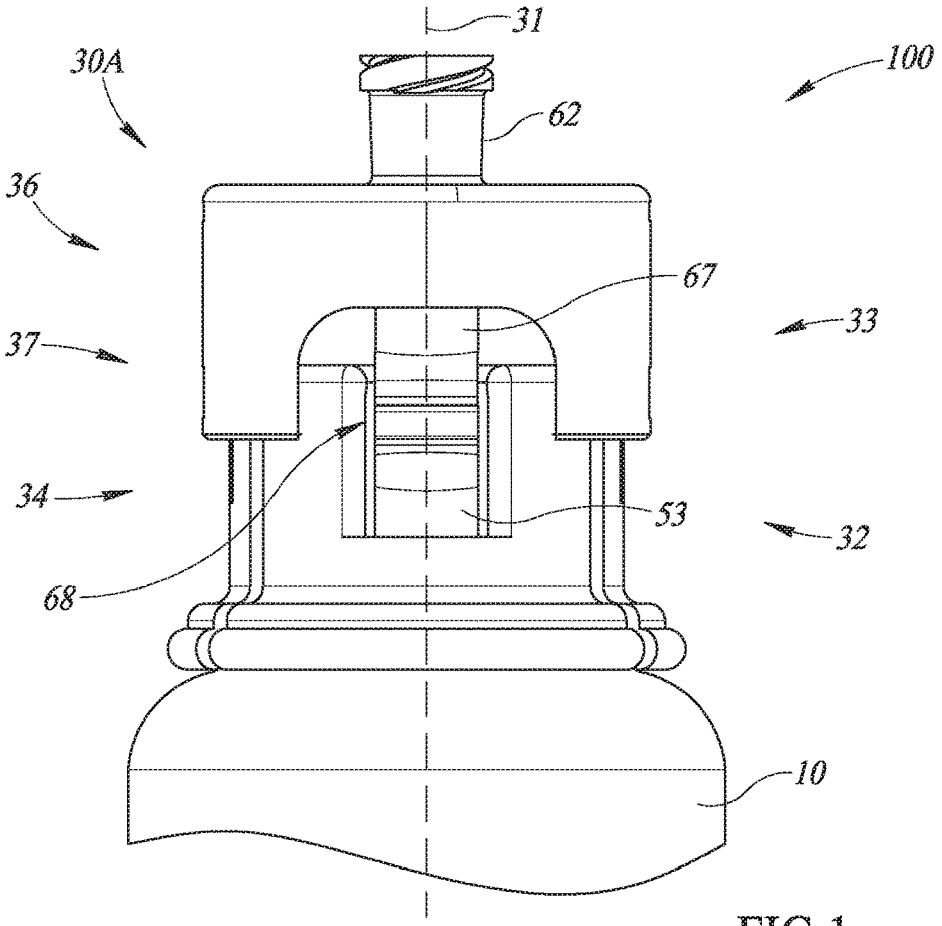
FIG. 1 is a front elevation view of a Ready-To-Use (RTU) liquid drug transfer assemblage including a first embodiment of a user actuated liquid drug transfer device in a pre-actuated state and a pre-attached user removable injection vial.
Figure 2:
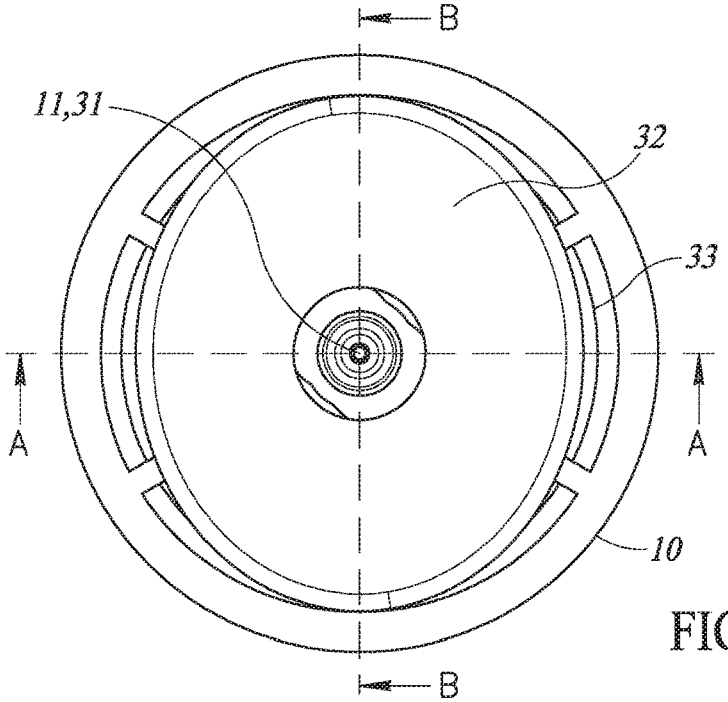
FIG. 2 is a top plan view of FIG. 1's RTU liquid drug transfer assemblage.
Figure 3:
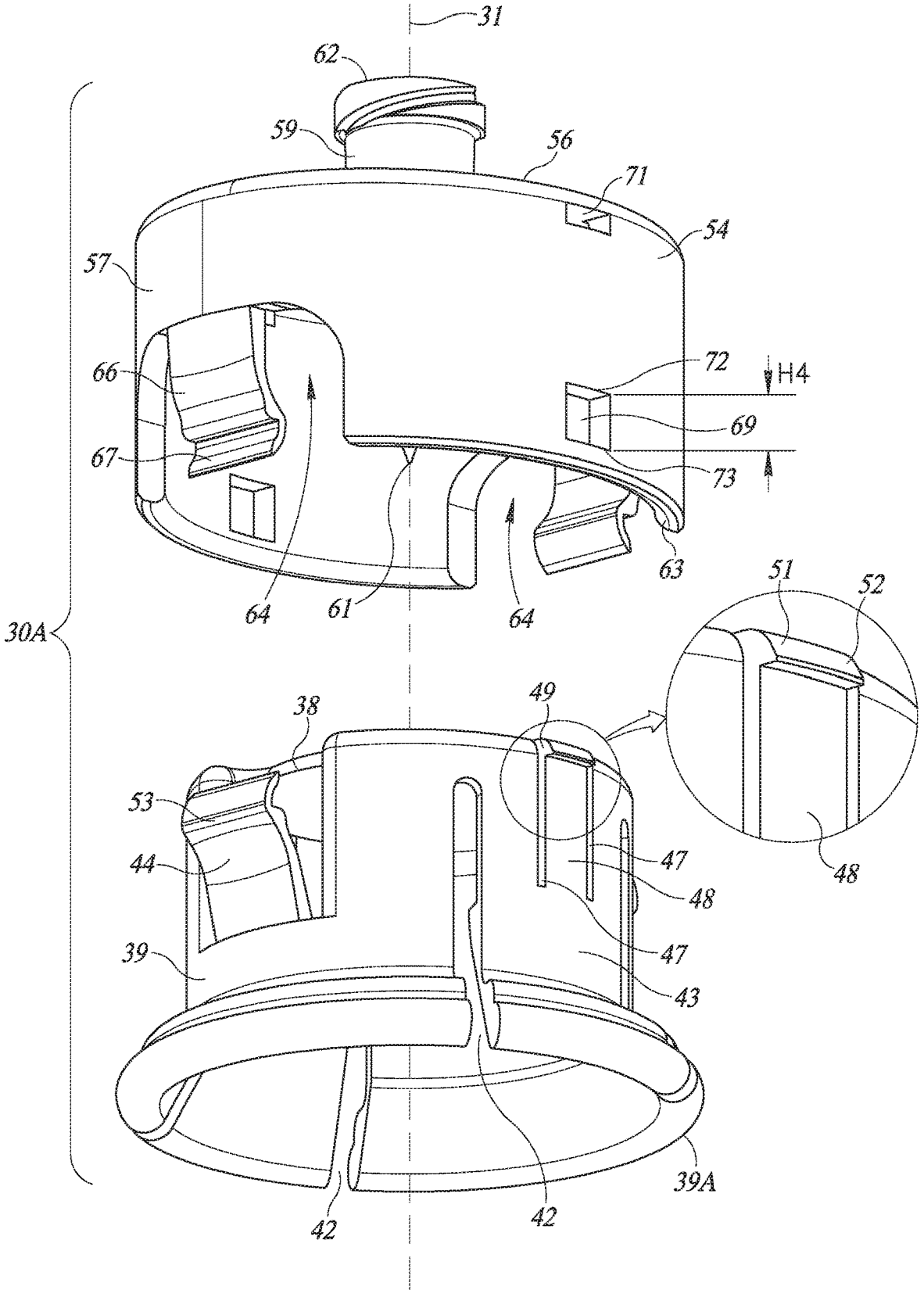
FIG. 3 is an exploded view of FIG. 1's liquid drug transfer device.
Figure 4:
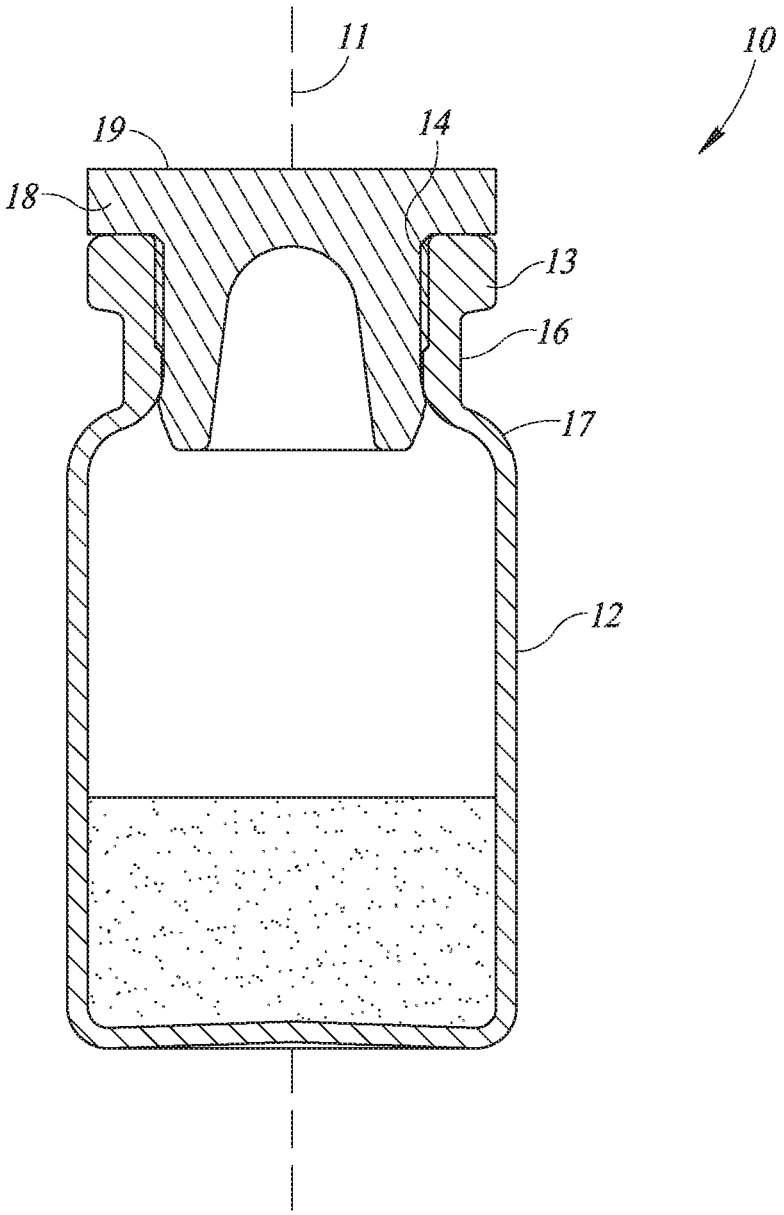
FIG. 4 is a longitudinal cross section of an injection vial of FIG. 1's RTU liquid drug transfer assemblage.

FIG. 1 to FIG. 7 show a Ready-To-Use (RTU) liquid drug transfer assemblage 100 including a user actuated liquid drug transfer device 30A in a pre-actuated state and a pre-attached injection vial 10. The injection vial 10 has a longitudinal injection vial centerline 11 and includes a closed end vial tube 12, a tubular vial crown 13 having a crown opening 14 and a vial neck 16 intermediate the vial tube 12 and the vial crown 13. The injection vial 10 includes a vial shoulder 17 intermediate the vial tube 12 and the vial neck 16. The injection vial 10 includes an injection vial stopper 18 stopping the crown opening 14 and an uppermost injection vial surface 19. The injection vial 10 can include powder contents requiring reconstitution to form a liquid drug. Alternatively, the injection vial 10 can include liquid contents requiring dilution for administration purposes.

The liquid drug transfer device 30A has a longitudinal device centerline 31 and includes an injection vial adapter 32 for telescopic snap fit mounting on the injection vial 10 and a liquid source adapter 33 initially mounted on the injection vial adapter 32 in a pre-actuated state. The liquid drug transfer device 30A includes a safety catch mechanism 34 for priming the liquid drug transfer device 30A ready for actuation thereby preventing inadvertent user actuation to puncture the intact non-punctured injection vial 10. The liquid drug transfer device 30A includes an extension limit arrangement 36 for limiting linear sliding extension of the liquid source adapter 33 from the vial injection adapter 32 on priming the liquid drug transfer device 30A. The liquid drug transfer device 30A includes a snap-fit securing arrangement 37 for securing the liquid source adapter 33 on the injection vial adapter 32 in an actuated state.

The injection vial adapter 32 includes a transverse injection vial adapter top surface 38 and a downward depending injection vial adapter skirt 39 for telescopic mounting on the vial crown 13. The downward depending injection vial adapter skirt 39 has a lowermost injection vial adapter skirt rim 39A. The injection vial adapter top surface 38 has a throughgoing injection vial adapter top surface aperture 41 overlying the uppermost injection vial surface 19. The injection vial adapter skirt 39 includes four longitudinal slits 42 forming a diametric resiliently flexible flex member pair 43. The injection vial adapter skirt 39 includes a diametric resiliently flexible longitudinal directed flex member pair 44 orthogonal to the flex member pair 43.

The flex member pair 43 each includes an inward directed protrusion 46 for snap fit under the vial crown 13. The flex member pair 43 each includes a longitudinal slit pair 47 forming a central longitudinal directed flex securing member 48 constituting a component of both the extension limit arrangement 36 and the snap fit securing arrangement 37. The flex securing members 48 each have a free end 49 flush with the injector vial adapter top surface 38. The free ends 49 are formed with an outward directed protrusion 51 having an inclined leading surface 52.

The diametric resiliently flexible longitudinal directed flex member pair 44 terminate at an inward directed hook 53 disposed toward the injection vial adapter top surface 38.

The liquid source adapter 33 includes a cap-like member 54 having a transverse liquid source adapter top surface 56 and a downward depending liquid source adapter skirt 57 for telescopically receiving the injection vial adapter 32 therein in an actuated state of the liquid drug transfer device 30A. The liquid source adapter 33 includes an integral dual ended liquid transfer member 58 having an upward liquid transfer member end 59 and terminating in a downward puncturing tip 61 for puncturing the injection vial stopper 18 for flow communication with the vial tube 12. The upward liquid transfer member end 59 is constituted by an upright liquid drug access port 62 protruding from the liquid source adapter top surface 56. The liquid drug access port 62 is preferably constituted by a female connector as shown for flow communication with a needleless syringe, a male connector, and the like.

The liquid source adapter skirt 57 has a lowermost liquid source adapter skirt rim 63 and is formed with a diametric cutaway pair 64 each with a resiliently flexible longitudinal directed flex member 66 terminating at an outward directed hook 67 adjacent with the liquid source adapter skirt rim 63. The safety catch mechanism 34 includes a diametric safety catch pair 68 each being constituted by an inward directed hook 53 and an outward directed hook 67.

The liquid source adapter skirt 57 includes a diametric extension limit aperture pair 69 adjacent the liquid source adapter skirt rim 63 and a diametric securing aperture pair 71 adjacent the liquid source adapter top surface 56. The extension limit aperture pair 69 each has an uppermost transverse rim 72 and a lowermost transverse rim 73.

The heights of the liquid drug transfer device 30A at its three different states: pre-actuated state, intermediate primed state and actuated state are indicated between the female connector 62 and the lowermost injection vial adapter skirt rim 39A. Accordingly, the liquid drug transfer device 30A has a pre-actuated height H1 (see FIG. 5) greater than its actuated height H2 (see FIG. 12). The liquid drug transfer device 30A has an intermediate primed height H3 (see FIG. 8) greater than its pre-actuated height H1 wherein H3=H1+H4 and H4 is the height of the extension limit aperture pair 69.

Figure 5:
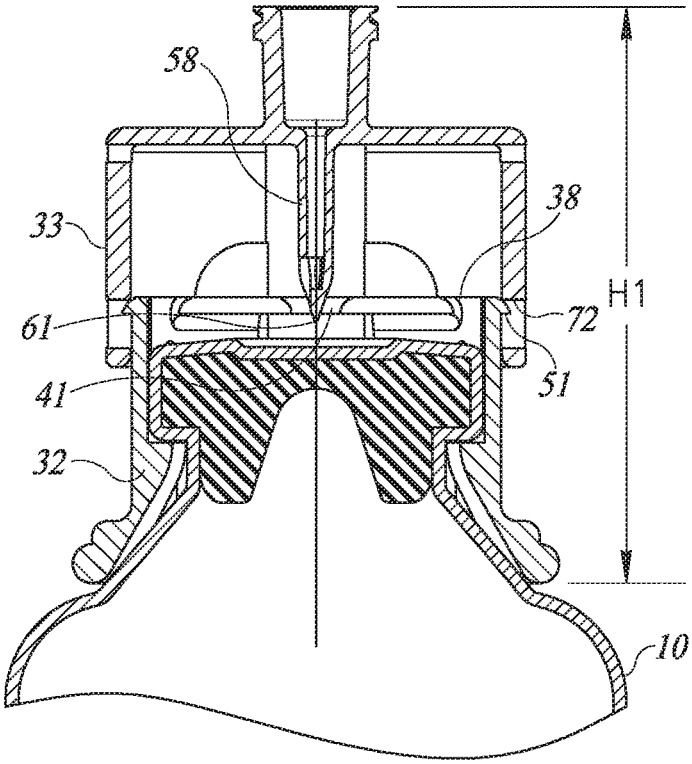
FIG. 5 is a longitudinal cross section of FIG. 1's RTU liquid drug transfer assemblage including its liquid drug transfer device in a pre-actuated state along line A-A in FIG. 2.
Figure 7:
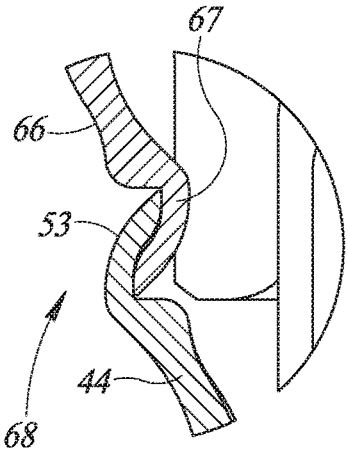
FIG. 7 is a close up view of the encircled area A in FIG. 6.
Figure 6:
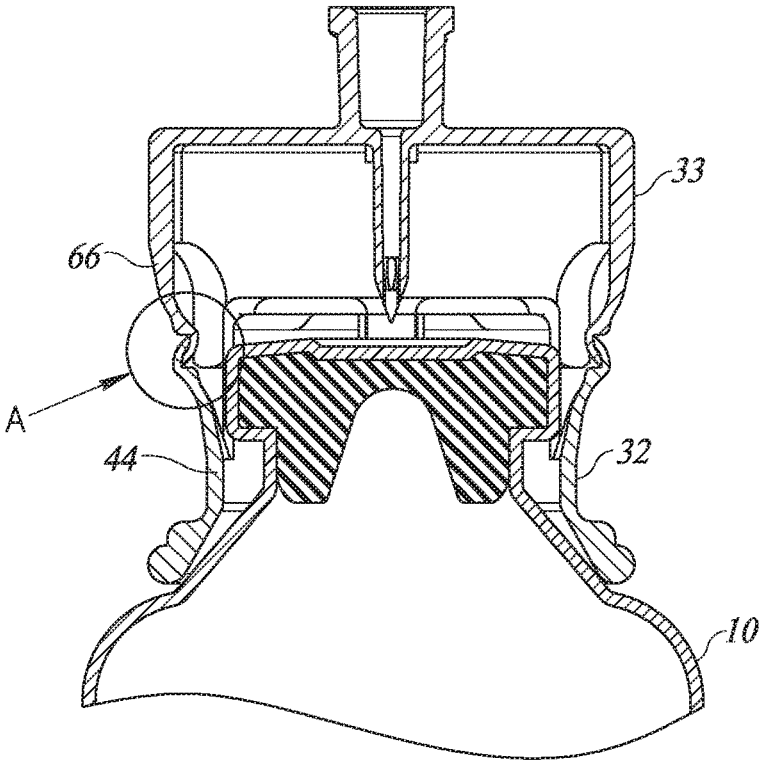
FIG. 6 is a longitudinal cross section of FIG. 1's RTU liquid drug transfer assemblage including its liquid drug transfer device in a pre-actuated state along line B-B in FIG. 2.

FIG. 5 to FIG. 13 show use of the liquid drug transfer device 30A is as follows:

FIG. 5 to FIG. 7 show the liquid drug transfer device 30A in a pre-actuated state at a height H1. The puncturing tip 61 overlies the uppermost injection vial surface 19. The outward directed protrusion pair 51 are deployed at the uppermost transverse rim pair 72. The flex member pair 44 are outwardly biased with respect to their non-flexed positions and the flex member pair 66 are inwardly biased with respect to their non-flexed positions such that the safety catch pair 68 are engaged. Accordingly, the safety catch mechanism 34 is operative for preventing an inadvertent user compaction of the liquid source adapter 33 towards the injection vial adapter 32 until after the priming of the liquid drug transfer device 30A.

Figure 8:
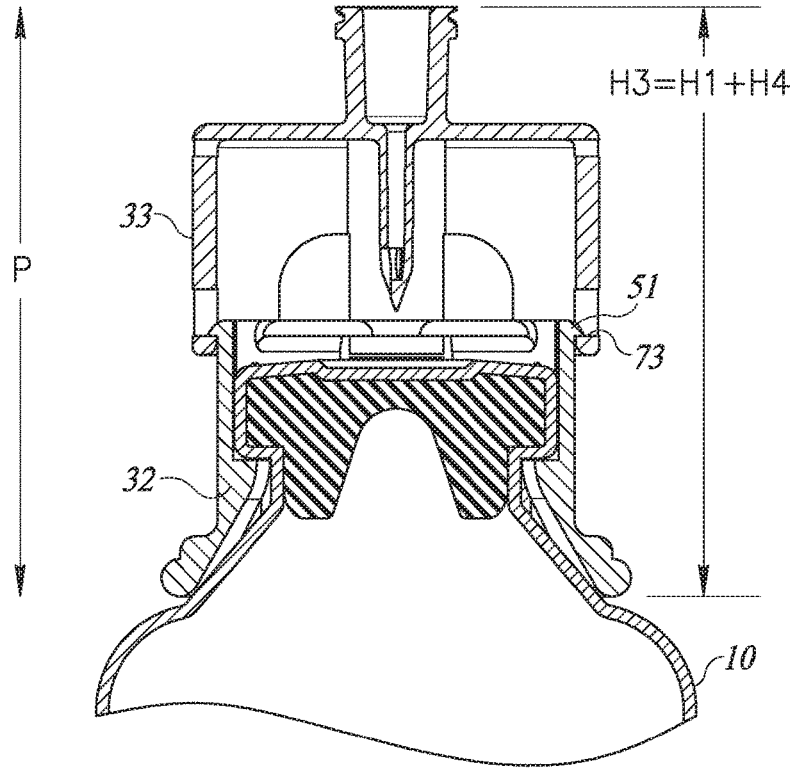
FIG. 8 is a longitudinal cross section of FIG. 1's RTU liquid drug transfer assemblage including its liquid drug transfer device in an intermediate primed state along line A-A in FIG. 2.
Figure 10:
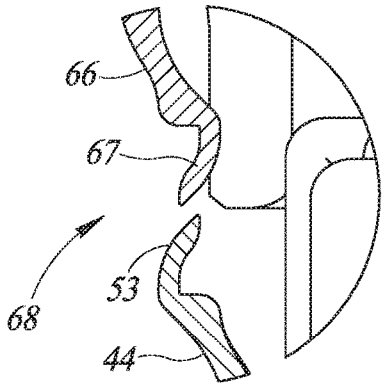
FIG. 10 is a close up view of the encircled area B in FIG. 9.
Figure 9:
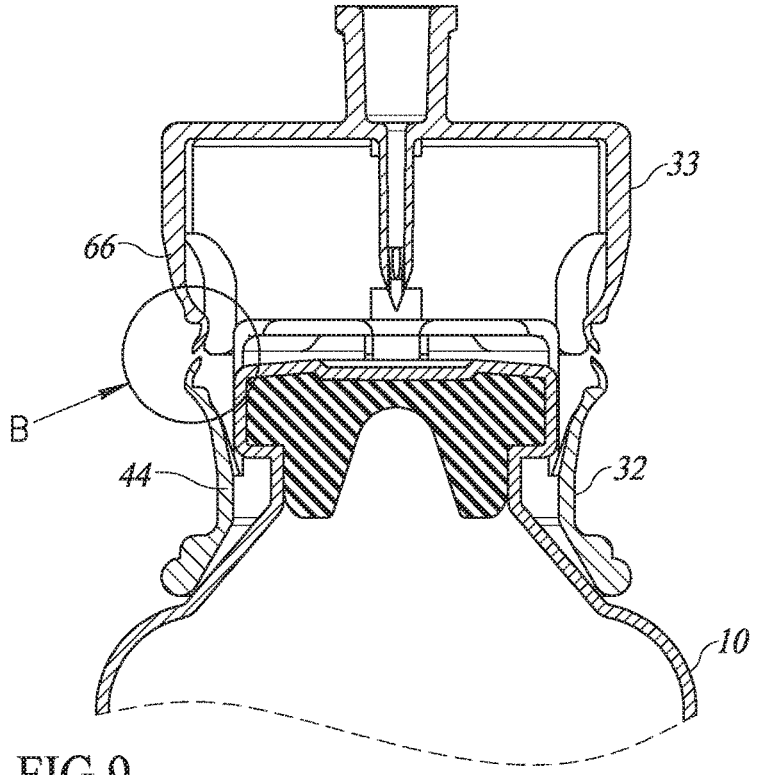
FIG. 9 is a longitudinal cross section of FIG. 1's RTU liquid drug transfer assemblage including its liquid drug transfer device in its intermediate primed state along line B-B in FIG. 2.

FIG. 8 to FIG. 10 show the liquid drug transfer device 30A in an intermediate primed state at the primed height H3 by virtue of an initial manual linear sliding extension denoted P for extending the liquid source adapter 33 from the injection vial adapter 32 being stopped by the outward directed protrusion pair 51 stopping against the lowermost transverse rim pair 73. The manual linear sliding extension disengages the inward directed hook pair 53 and the outward directed hook pair 67 such that the flex member pair 44 and flex member pair 66 assume their non-flex positions, thereby releasing the safety catch mechanism 34.

Figure 11:
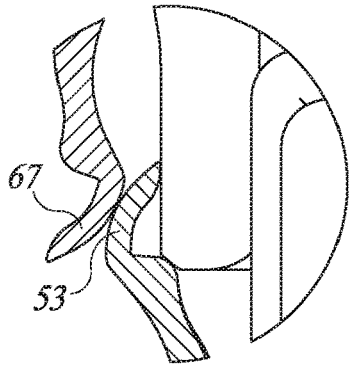
FIG. 11 is a close up view showing non engagement of the safety catch mechanism on compaction of FIG. 1's liquid drug transfer device from its intermediate primed state towards its actuated state.

FIG. 11 shows the beginning of a subsequent manual linear sliding compaction for compacting the liquid drug transfer device 30A from its intermediate primed state towards its actuated state. The outward directed hook pair 67 contact the inward directed hook pair 53 thereby causing an instantaneous outwardly flexing of the flex member pair 66 and an instantaneous inward flexing of the flex member pair 44 until the inward directed hook pair 53 and the outward directed hook pair 67 pass each other whereupon the flex member pair 44 and flex member pair 66 revert to their non-flexed positions. The height difference H1−H2 equals the displacement the liquid source adapter 33 has to travel from its pre-actuated state in which the puncturing tip 61 overlies the uppermost injection port surface 19 to its actuated state in which the puncturing tip 61 protrudes through the injection vial stopper 18.

Figure 12:
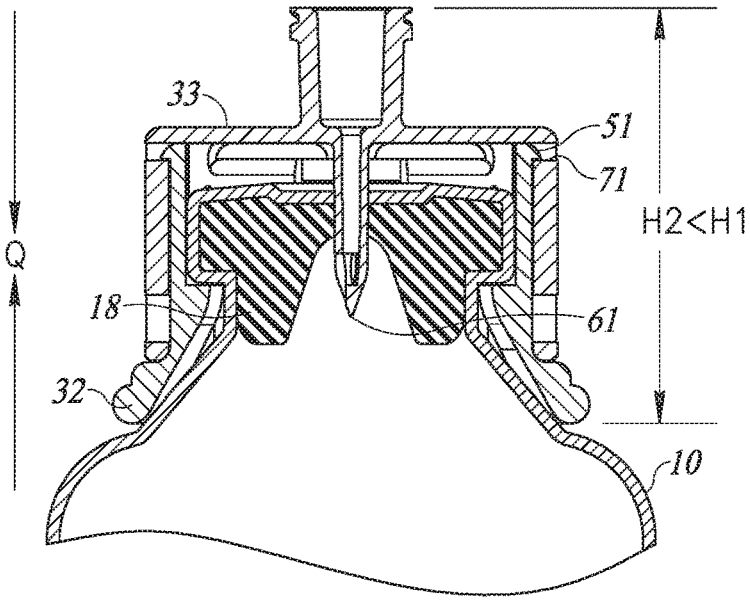
FIG. 12 is a longitudinal cross section of FIG. 1's RTU liquid drug transfer assemblage including its liquid drug transfer device in an actuated state along line A-A in FIG. 2.
Figure 13:
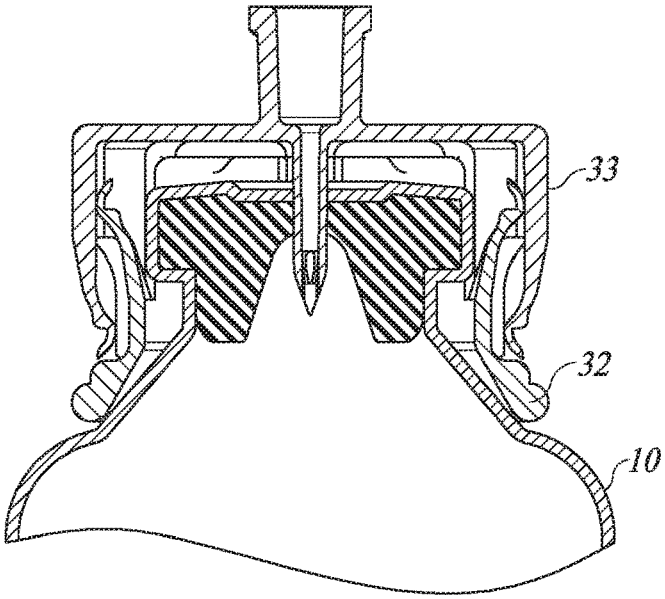
FIG. 13 is a longitudinal cross section of FIG. 1's RTU liquid drug transfer assemblage including its liquid drug transfer device in an actuated state along line B-B in FIG. 2.

FIG. 12 and FIG. 13 show the liquid drug transfer device 30A in its actuated state after a complete manual compaction denoted Q. The user compaction releases the outward directed protrusion pair 51 from the extension limit aperture pair 69 such that they slide on the inside surface of the cap-like member 54 towards the securing aperture pair 71 and urges the puncturing tip 61 though the injection vial stopper 18 for flow communication with the injection vial 10. The outward directed protrusion pair 51 correspondingly snap into the securing aperture pair 71 in the actuated state thereby securing the actuated liquid drug transfer device 30A. The flex member pair 44 and the flex member pair 66 are correspondingly substantially co-extensive.

Figure 14:
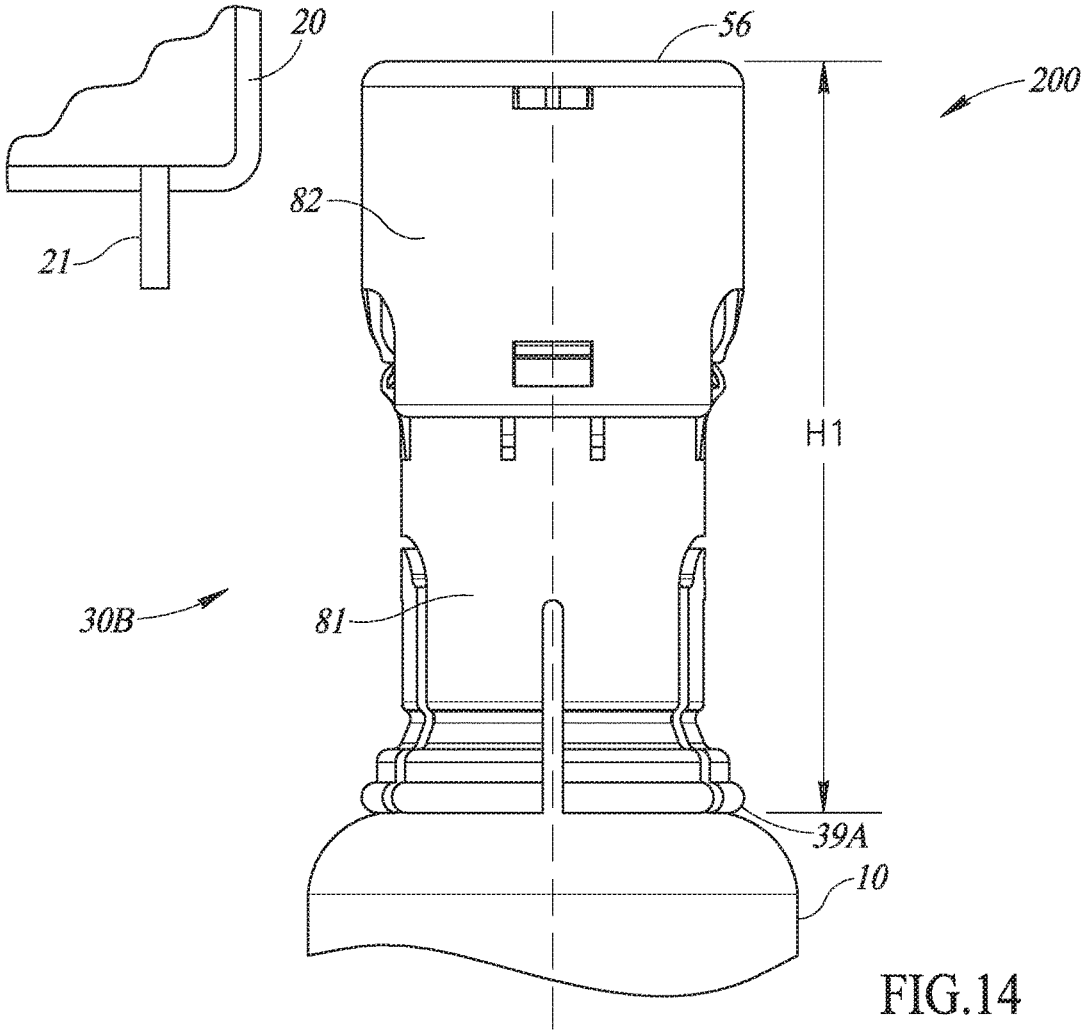
FIG. 14 is a front elevation view of a Ready-To-Use (RTU) liquid drug transfer assemblage including a second embodiment of a user actuated liquid drug transfer device in a pre-actuated state and a pre-attached injection vial and an infusion bag.
Figure 15:
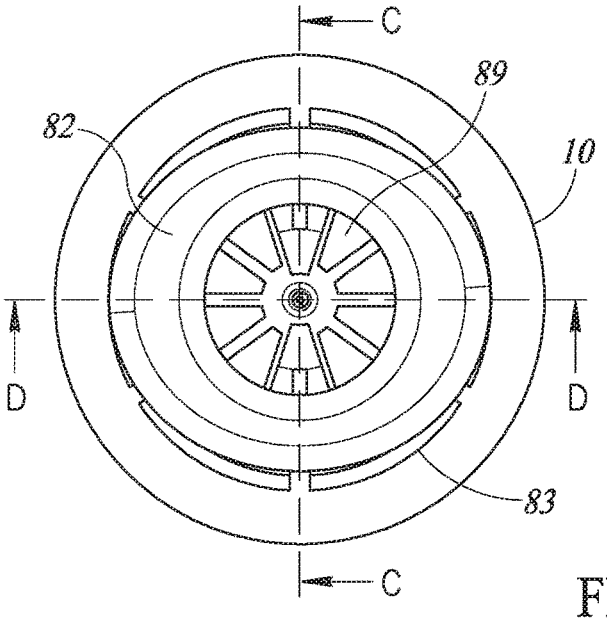
FIG. 15 is a top plan view of FIG. 14's RTU liquid drug transfer assemblage.
Figure 16:
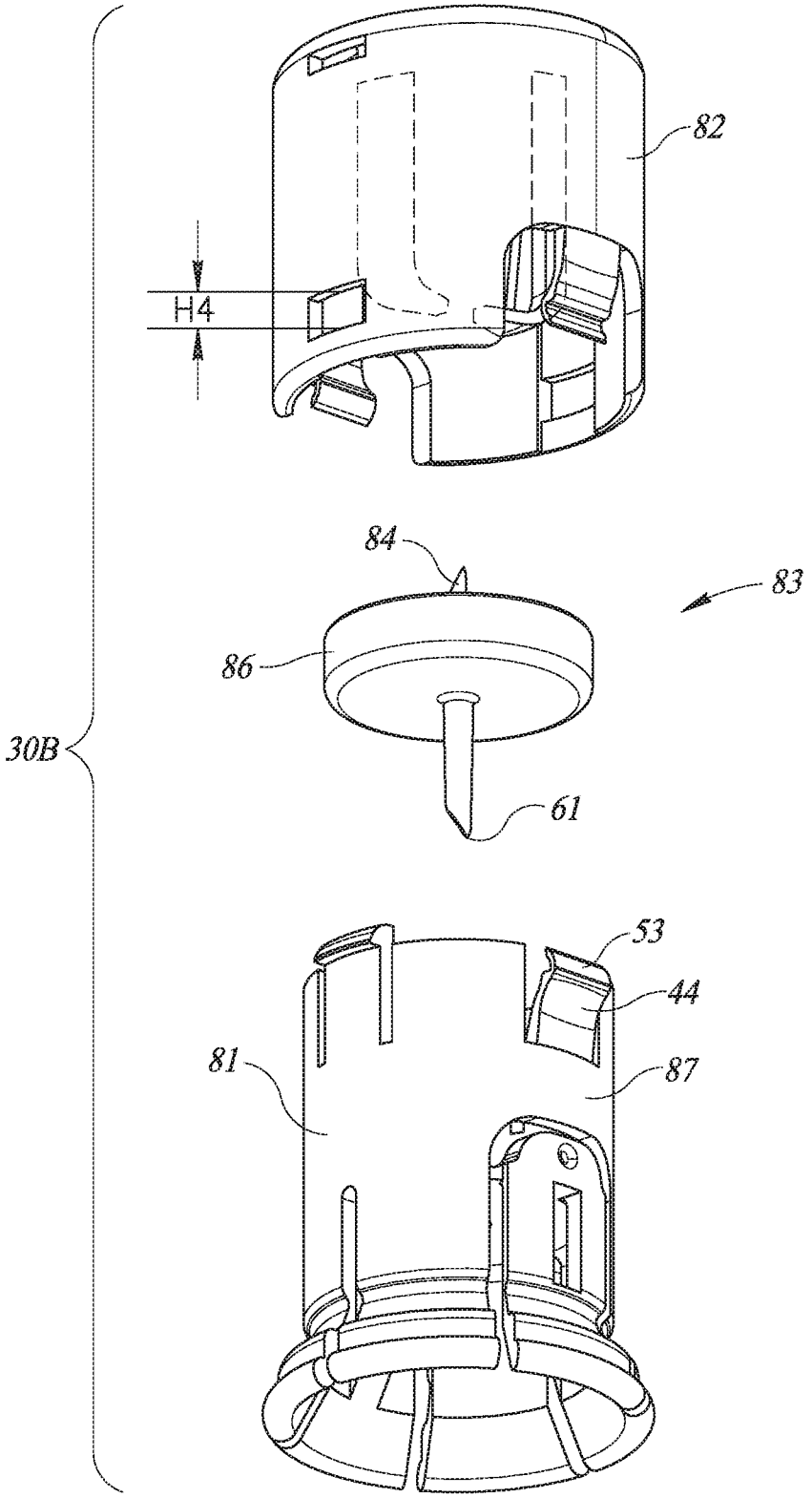
FIG. 16 is an exploded view of FIG. 14's liquid drug transfer device.

FIG. 14 to FIG. 16 show a RTU liquid drug transfer assemblage 200 including a liquid drug transfer device 30B having a similar construction as the liquid drug transfer device 30A and therefore similar parts are likewise numbered. The latter 30B differs from the former 30A insofar as it is intended to be used with a liquid source also requiring a puncturing action. The liquid source can be in the form of an infusion liquid source, and the like. The liquid drug transfer device 30B is shown implemented for flow connection with an infusion bag 20 having an injection port 21 and an administration port 22.

The liquid drug transfer device 30B includes a three component construction as opposed to the liquid drug transfer device 30A's two component construction. The liquid drug transfer device 30B includes an injection vial adapter 81, a liquid source adapter 82 and a discrete dual ended liquid transfer member 83 interdisposed between the injection vial adapter 81 and the liquid source adapter 82. The dual ended liquid transfer member 83 includes an upward liquid transfer member end 84 also terminating in a puncturing tip similar to the puncturing tip 61. The dual ended liquid transfer member 83 includes an intermediate circular flange 86.

The injection vial adapter 81 includes an upward sleeve 87 mounted on the injection vial adapter top surface 38 for supporting the circular flange 86 in the liquid drug transfer device 30B's pre-actuated state and the intermediate primed state. The upward sleeve 87 is formed with the diametric flex member pair 44 formed with the inward directed hooks 53 and the diametric flex securing member pair 48.

The liquid source adapter top surface 56 is formed with an injection port connector 89 for slidingly receiving the injection port 21 and a diametric inward directed injection port stopper pair 91 for stopping the insertion of the injection port 21 therein. The upward liquid transfer member end 84 underlies the injection port 21 in the liquid drug transfer device 30B's pre-actuated state.

The liquid drug transfer device 30B has a pre-actuated height H1, an actuated height H2 and an intermediate primed height H3 similar to the liquid drug transfer device 30A. The heights are indicated between the liquid source adapter top surface 56 and the lowermost injection vial adapter skirt rim 39A. The height difference H1–H2 equals the displacement that the liquid drug transfer device 30B has to compact from its pre-actuated state in which the puncturing tip 61 overlies the uppermost injection port surface 19 and the upward liquid transfer member end 84 underlies the injection port 21 to its actuated state in which the puncturing tip 61 protrudes through the injection vial stopper 18 and the upward liquid transfer member end 84 punctures through the injection port 21.

Figure 17:
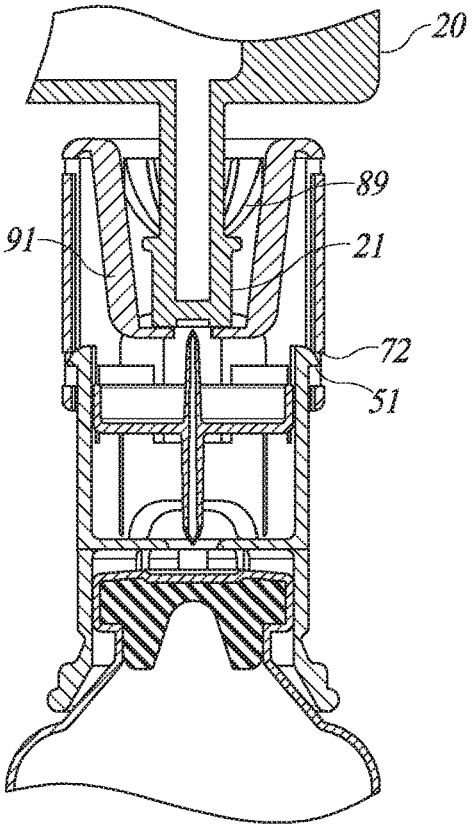
FIG. 17 is a longitudinal cross section of FIG. 14's RTU liquid drug transfer assemblage in a pre-actuated state along line C-C in FIG. 15.
Figure 18:
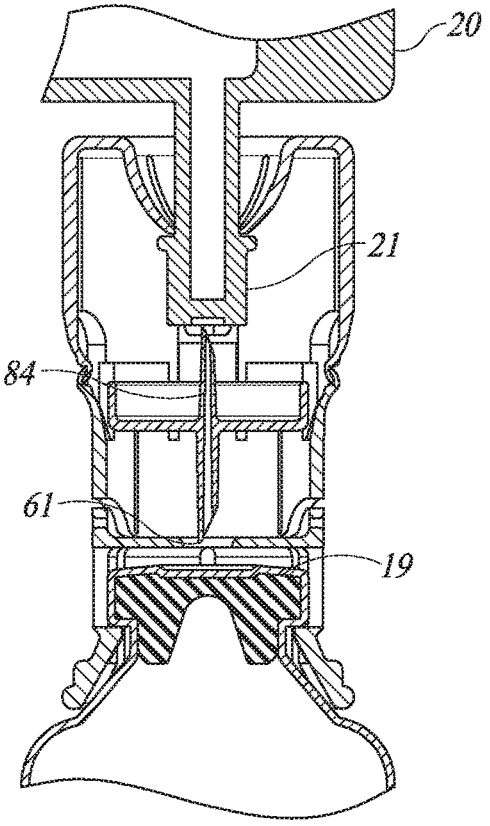
FIG. 18 is a longitudinal cross section of FIG. 14's RTU liquid drug transfer assemblage in a pre-actuated state along line D-D in FIG. 15.

FIG. 17 to FIG. 22 show the use of the liquid drug transfer device 30B with an injection vial 10 and an infusion bag 20 is as follows:

FIG. 17 and FIG. 18 show the liquid drug transfer device 30B in a pre-actuated state at height H1. The puncturing tip 61 overlies the uppermost injection vial surface 19. The puncturing tip 84 underlies the injection port connector 21. The safety catch mechanism 34 prevents an inadvertent compaction. The outward directed protrusion pair 51 are deployed at the uppermost transverse rim pair 72.

Figure 19:
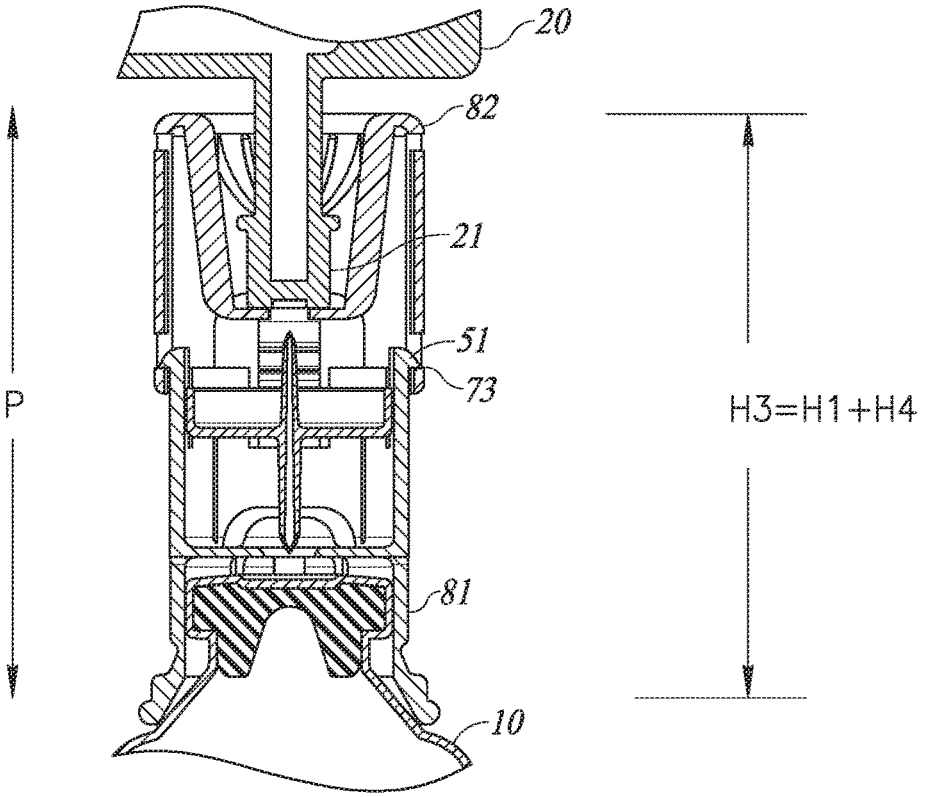
FIG. 19 is a longitudinal cross section of FIG. 14's RTU liquid drug transfer assemblage in an intermediate primed state along line C-C in FIG. 15.
Figure 20:
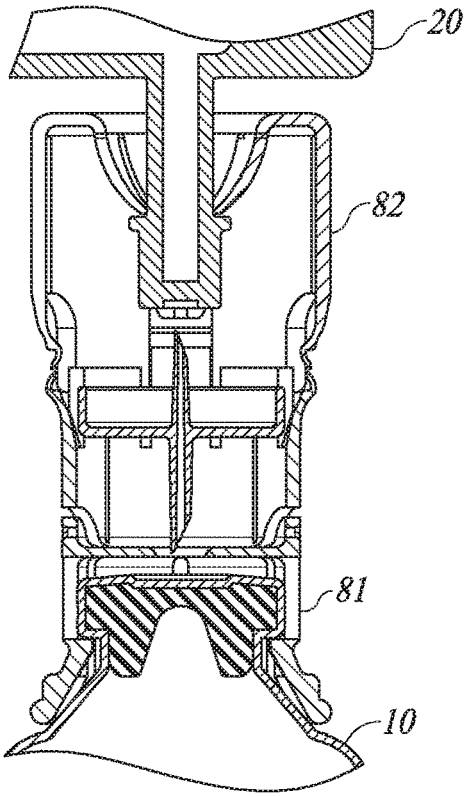
FIG. 20 is a longitudinal cross section of FIG. 14's RTU liquid drug transfer assemblage in its intermediate primed state along line D-D in FIG. 15.

FIG. 19 and FIG. 20 show the liquid drug transfer device 30B in an intermediate primed state at height H3 after an initial manual linear sliding extension denoted P. The safety catch mechanism 34 is disengaged. The outward directed protrusion pair 51 stop against the lowermost transverse rim pair 73.

Figure 21:
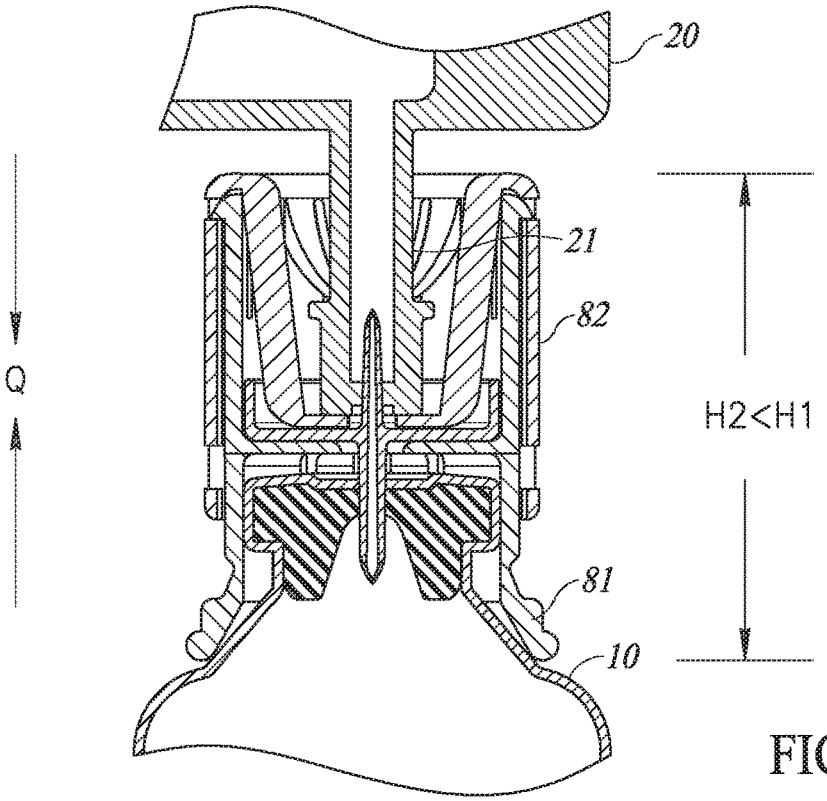
FIG. 21 is a longitudinal cross section of FIG. 14's RTU liquid drug transfer assemblage in an actuated state along line C-C in FIG. 15 in flow communication with the infusion bag.
Figure 22:
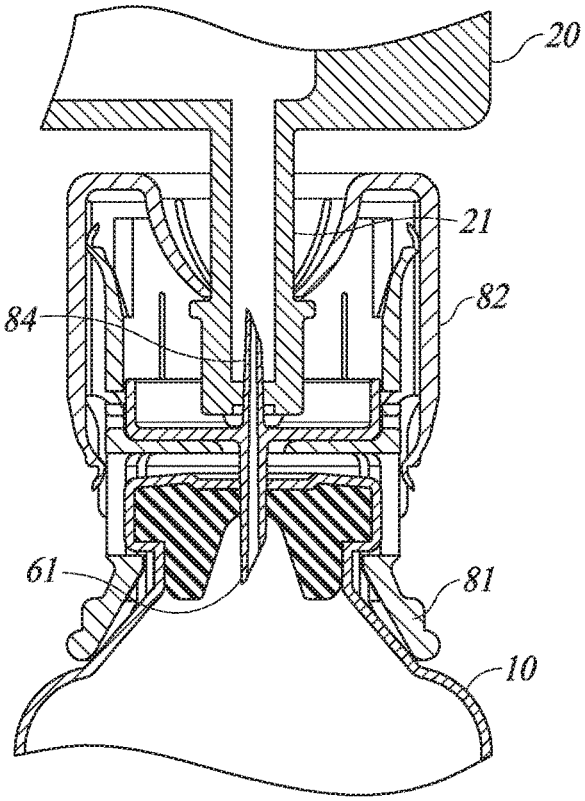
FIG. 22 is a longitudinal cross section of FIG. 14's RTU liquid drug transfer assemblage in an actuated state along line D-D in FIG. 15 in flow communication with the infusion bag.

FIG. 21 and FIG. 22 show the liquid drug transfer device 30B in an actuated state at height H2 after a subsequent manual compaction denoted Q. The puncturing tip 61 punctures though the injection vial stopper 18 for flow communication with the injection vial 10. The puncturing tip 84 punctures the injection port 21 for flow communication with the infusion bag 20 thereby enabling flow communication between the infusion bag 20 and the injection vial 10. The outward directed protrusion pair 51 snap into the securing aperture pair 71.

Figure 23:
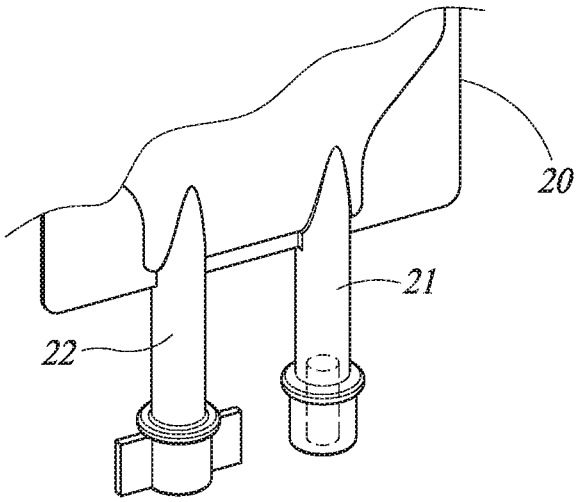
FIG. 23 is a front perspective view of a third embodiment of a user actuated liquid drug transfer device in a pre-actuated state.
Figure 23:
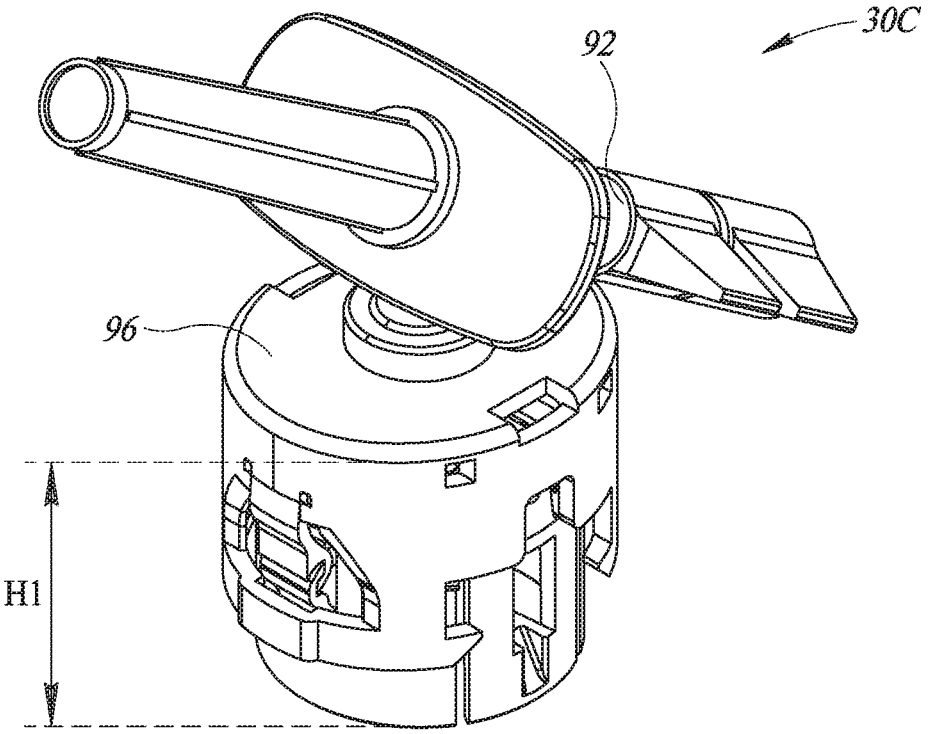
Figure 24:
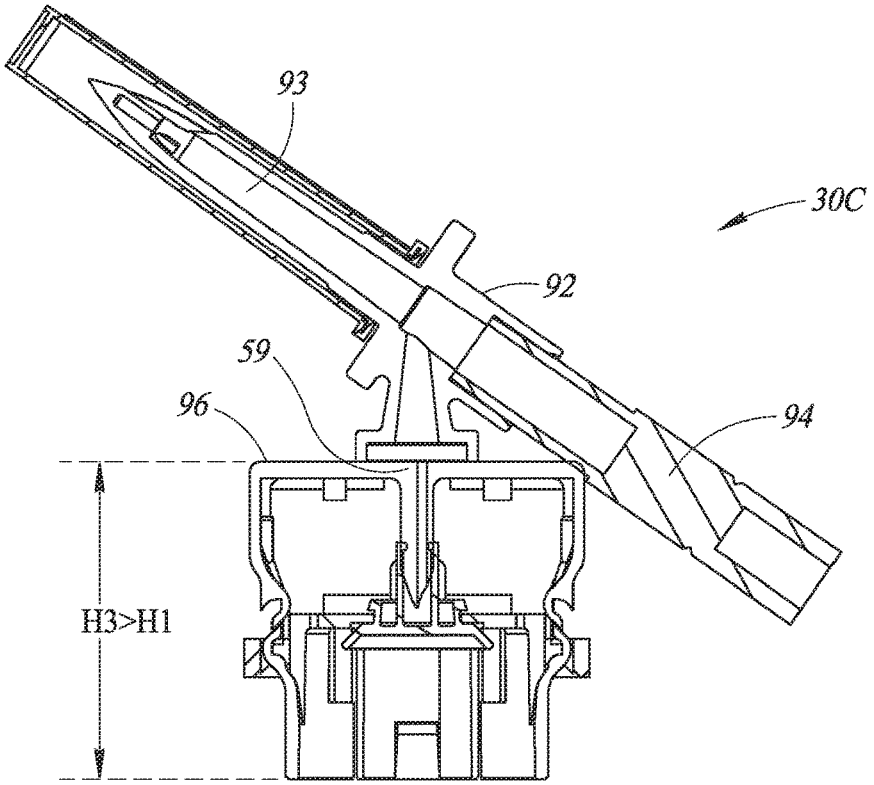
FIG. 24 is a longitudinal cross section of FIG. 23's liquid drug transfer device in an intermediate primed state.
Figure 25:
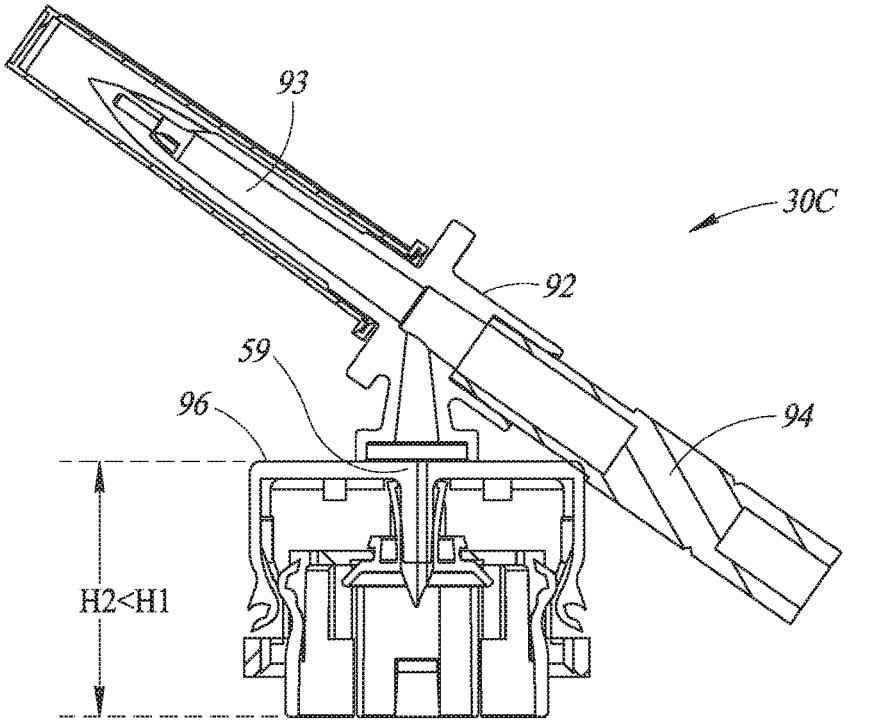
FIG. 25 is a longitudinal cross section of FIG. 23's liquid drug transfer device in an actuated state.

FIG. 23 to FIG. 25 show a liquid drug transfer device 30C also for use with the infusion bag 20. The liquid drug transfer device 30C has a similar construction and operation as the liquid transfer device disclosed in commonly owned PCT International Application No. PCT/IL2014/050680 entitled Liquid Transfer Devices for use with Infusion Liquid Containers and published under PCT International Publication No. WO 2015/019343 FIG. 4 and FIG. 5. The liquid drug transfer device 30C includes a trifurcated body 92 having an IV spike 93 for sliding sealed insertion into an infusion bag's administration port, a substitute IV port 94 for sliding sealed insertion of an infusion set and an integral vial adapter 96 constituted by the liquid drug transfer device 30A where the upward liquid transfer member end 59 is in continuous flow communication with the IV spike 93 and the substitute IV port 94.

While particular embodiments of the present invention are illustrated and described, it would be obvious to those skilled in the art that various other changes and modifications can be made without departing from the spirit and scope of the invention.

The invention claimed is:

1. A user actuated liquid drug transfer device for use in a Ready-To-Use (RTU) liquid drug transfer assemblage for establishing flow communication between a liquid source and an injection vial, the injection vial including a closed end vial tube, and a tubular vial crown having a crown opening stopped by an injection vial stopper, the injection vial having an uppermost injection vial surface, the liquid drug transfer device having a longitudinal device centerline and comprising:

(a) an injection vial adapter having a transverse injection vial adapter top surface and a downward depending injection vial adapter skirt intended for telescopic mounting on the vial crown, said transverse injection vial adapter top surface including a transverse injection vial adapter top surface aperture along the longitudinal device centerline overlying the uppermost injection vial surface on said telescopic mounting on the injection vial;

(b) a liquid source adapter intended for attachment to the liquid source, said liquid source adapter including a transverse liquid source adapter top surface and a downward depending liquid source adapter skirt mounted on said injection vial adapter in a pre-actuated state of the liquid drug transfer device and configured for telescopically receiving said injection vial adapter therein in an actuated state of the liquid drug transfer device on user compaction of the liquid drug transfer device from said pre-actuated state to an actuated state;

(c) a dual ended liquid transfer member having an upward liquid transfer member end for flow communication with the liquid source and a downward liquid transfer member end in flow communication with said upward liquid transfer member end and terminating in a puncturing tip for puncturing the injection vial stopper for flow communication with the vial tube, said puncturing tip overlying the uppermost injection vial surface in said pre-actuated state and puncturing through the injection vial stopper in said actuated state;

(d) a safety catch mechanism requiring an initial manual linear sliding extension for extending said liquid source adapter from said injection vial adapter for priming the liquid drug transfer device to an intermediate primed state, thereby enabling said user compaction from said pre-actuated state to said actuated state;

(e) an extension limit arrangement for limiting said linear sliding extension of said liquid source adapter from said vial injection adapter in said intermediate primed state; and (f) a snap fit securing arrangement for securing said liquid source adapter on said injection vial adapter in said actuated state.

2. The device according to claim 1 wherein said safety catch mechanism having at least one safety catch each constituted by said liquid source adapter having a downward depending resiliently flexible longitudinal directed flex member terminating at an outward directed hook and said injection vial adapter having an upward resiliently flexible longitudinal directed flex member terminating at an inward directed hook, said outward directed hook engaging said inward directed hook in said pre-actuated state, said outward directed hook being disengaged from said inward directed hook in said intermediate primed state and said outward directed hook sliding past said inward directed hook on compaction of the liquid drug transfer device from said intermediate primed state to said actuated state wherein said downward depending resiliently flexible longitudinal directed flex member and said upward resiliently flexible longitudinal directed flex member are substantially co-extensive in said actuated state.

3. The device according to claim 1 wherein said injection vial adapter includes a longitudinal directed flex member with an outward directed protrusion, said liquid source adapter skirt includes a longitudinal directed elongated extension limit aperture disposed remote from said liquid source adapter top surface and a securing aperture disposed adjacent said liquid source adapter top surface, said outward directed protrusion engaging said extension limit aperture for limiting said extension of said liquid source adapter from said injection vial adapter in said intermediate primed state and said outward directed protrusion engaging said securing aperture for securing said liquid source adapter on said injection vial adapter in said actuated state.

4. The device according to claim 1 for use with a male connector and wherein said liquid source adapter is integrally formed with said dual ended liquid transfer member and said upward liquid transfer member end is constituted by an access transfer port for flow communication with the male connector.

5. The device according to claim 1 for use with an infusion bag having an injection port and wherein said dual ended liquid transfer member is a discrete component interdisposed between said injection vial adapter and said liquid source adapter and said dual ended liquid transfer member terminates in a second puncturing tip constituting said upward liquid transfer member end for puncturing the injection port in said actuated state.

6. The device according to claim 1 for use with an infusion bag having an administration port and wherein the liquid drug transfer device includes a trifurcated body having an IV spike for sliding sealed insertion into the infusion bag's administration port, a substitute IV port for sliding sealed insertion of an infusion set, and said liquid source adapter, said liquid source adapter being integrally formed with said dual ended liquid transfer member and said upward liquid transfer member end being in continuous flow communication with said IV spike and said substitute IV port.

7. A Ready-To-Use (RTU) liquid drug transfer assemblage including a liquid drug transfer device according to claim 1.

* * * * *